US007597175B2

(12) United States Patent
Reed

(10) Patent No.: US 7,597,175 B2
(45) Date of Patent: Oct. 6, 2009

(54) REED'S HIGH-RISE EMERGENCY RESCUE EGRESS SYSTEM

(76) Inventor: Waymon Burton Reed, #28 Air Force Dr., P.O. Box 492, Pottsboro, TX (US) 75076

( * ) Notice: Subject to any disclaimer, the term of this patent is extended or adjusted under 35 U.S.C. 154(b) by 688 days.

(21) Appl. No.: 11/237,292

(22) Filed: Sep. 28, 2005

(65) Prior Publication Data

US 2006/0065485 A1 Mar. 30, 2006

Related U.S. Application Data

(60) Provisional application No. 60/614,539, filed on Sep. 30, 2004, provisional application No. 60/555,998, filed on Mar. 24, 2004.

(51) Int. Cl.
*E04G 3/28* (2006.01)

(52) U.S. Cl. ..... 182/145; 182/142

(58) Field of Classification Search ..... 182/142, 182/82, 37

See application file for complete search history.

(56) References Cited

U.S. PATENT DOCUMENTS 4,386,680 A * 6/1983 Reed ..... 182/142
4,811,819 A * 3/1989 Sugiyama ..... 182/37
4,865,155 A * 9/1989 Montaigne et al. ..... 182/14
5,927,432 A * 7/1999 Hershtik ..... 182/82

* cited by examiner

*Primary Examiner*—Katherine W Mitchell
*Assistant Examiner*—Candace L. Bradford

(57) ABSTRACT

Reed's High-Rise Emergency Rescue Egress System, a conventional truck chassis fitted with a hydraulic lift system for access into and the evacuation of individuals from high-rise buildings. The technology is comprised of the following components: A control room located behind the cab of the truck, which is used to operate the lift system, monitor system operations, detect chemical, radiological, biological or other hazardous agents, and provides communication support; an gondola cabins which provides protection while transporting personnel and equipment up and down. The gondola has the ability to be connected to a building's internal/external water stand-pipe system to allow hoses to be used directly from the cabin and an audio/video monitoring system that transmits information to the control room; a mechanical lift system, which utilizes hydraulic and electrical lifts. The lift system is powered by the vehicle's motor. The lift system is augmented by an electrical/hydraulic turntable frame that maneuvers a platform containing the gondola cabin and allows for the gondola cabin to be extended and retracted, raised and lowered. Additionally, buildings can have an optional fixed or portable cantilever system that also aids in the movement of the cabin. The ground rescue vehicle and the roof cantilever system may move vertically simultaneously.

1 Claim, 15 Drawing Sheets

REED'S HIGH-RISE EMERGENCY RESCUE EGRESS SYSTEM

CROSS-REFERENCE TO RELATED APPLICATIONS

This application is a continuation of Provisional Patent Application No. 60/555,998 filed Mar. 24, 2004 and Provisional Patent Application No. 60/614,539 filed Sep. 30, 2004.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

Regarding emergency rescue and evacuation, fire departments have no efficient and safe systems with which to service emergencies above the reach of ladder trucks. Reed's High-Rise Emergency Rescue Egress System would provide quicker access to the crisis and a safe escape for emergency responders and the inhabitants occupying a high-rise building during a disaster.

The use of this high-rise system would result in lower operating cost and limited municipal liability caused by fires, earthquakes, terrorist attacks or other high-rise emergencies. Those who will benefit from the cost efficient system come from the private and public sector, high-rise owners, building operation management companies, tenants, metropolitan cities, county communities, insurance companies and all property owners.

Several publications have documented the aforesaid danger to life, as evidenced in Mr. Catalan's U.S. Pat. No. 6,598,703 B1. Mr. Catalan's invention illustrates a series of collapsible chutes on the exterior walls of a high-rise building, to evacuate occupants in case of emergencies. The prior art demonstrated by Mr. Catalan would allow users to be overcome by smoke inhalation due to the fact the interior structure of the descending chute apparatus is designed similar to a chimney or flue structure plan and could possibly cause such a system to draw or pull smoke inward, and upward, thus, causing injury or death to the occupants. Further, emergency responders have limited access to the upper floors due in part to the downward spiral of Mr. Catalan's emergency evacuation system. It should also be noted that such a system would be limited to stability and movement around the face of a high-rise building.

Another prior art high-rise emergency evacuation system is demonstrated by Mr. Kucher, U.S. Pat. No. 4,640,384. Mr. Kucher's prior art depicts an evacuation system which contains a wench and cable device placed on the parapet of a high-rise building which allows cable to be lowered and connected to a platform type carrier and said cabin being controlled by a mechanical ground unit using an electric umbilical cord for control. Most high-rise building codes will not allow weight to be placed on the upper, exterior wall structure of a high-rise building. Mr. Kucher's high-rise evacuation system could be restricted because of wind currents and positioning outside the walls of a high-rise building. Another disadvantage may be the lack of roof access abilities for the emergency responders. Most firemen and firefighters are reluctant to use fire fighting equipment that may be operated by people other than their fire fighting factuality. Mr. Kucher's prior art describing his emergency evacuation invention does not afford firemen the choice for operating such a system.

Mr. Lian-Chen Chen, U.S. Pat. No. 6,467,575, proposes, in prior art, an emergency evacuation device, for high-rise buildings which deploys a chute type conglomeration, from a movable roof-mount, rail system, that allow building occupants to enter the device and slide to safety, below. A movable chute evacuation system such as Mr. Chen's is limited because of different size and shape high-rise buildings and window openings for access and egress. The configuration of this type of evacuation system would not be cost effective for the building owners and might be hazardous for those who elected to use such a system. Each of these prior art references demonstrates efforts to devise high-rise building external rescue devices which are dependable. None of the prior art devices, however, have met this requirement.

REFERENCES CITED

U.S. patent Documents

| | | | |
|---|---|---|---|
| 6,598,703 | July, 2003 | Catalan | 182/142 |
| 4,640,384 | February, 1987 | Kucher | 182/142, 143, 145 |
| 6,467,575 | October, 2002 | Chen | 148/48 |

BRIEF SUMMARY OF THE INVENTION

Reed's High-Rise Emergency Rescue Egress System is a custom designed piece of firefighting equipment used to deliver emergency responders to a high-rise building, in the event of a fire or other emergencies, and rescue victims trapped in rooms or roof tops who are too high up to jump and out of the reach of hook and ladder trucks. There are seven operational sections to Reed's Emergency High-Rise Rescue Egress System and require three operators to operate. The seven major sections are; the vehicle, control room, body, draw-works, gondola, block and a roof-mount cantilever.

Three trained operators are required to manage Reed's High-Rise Emergency Egress System. Operators I, II and III wear voice activated helmets and communicate with each other during each phase of the rescue operation. Voice activated communication allow each of the operators to use their hands for performing and operating controls, and to make necessary equipment adjustments during rescue operations. Operator I, located in a ground vehicle control room manages the movement and functions of the entire high-rise emergency rescue egress system. Operator II is positioned on the gondola's roof mounted safety platform and makes necessary connections for operating the high-rise emergency rescue egress system. Operator III is positioned between the body's draw-works section and the gondola to make necessary connections for successfully operating the high-rise emergency rescue egress system.

Reed's High-Rise Emergency Egress System consists of seven functional pieces of equipment:

Vehicle:

Reed's High-Rise Emergency Rescue Egress Vehicle is a self-powered mobile ground unit that includes a cab that accommodates emergency control switches and levers that directs power and control to an operator's control room built on the vehicle's body that manages all functions of the rescue system. Power to operate the high-rise emergency rescue egress system is supplied from the vehicle's motor. The vehicle's crankshaft is linked to the vehicle's bumper mounted hydraulic pump, that engages hydraulic motors, which powers cable drums that lifts the gondola and transports passengers and equipment up and down the outside of a high-rise building. The high-rise emergency rescue vehicle is outfitted with lifting and stabilizing steel cables, electric hydraulic wenches and drums, gondola, visual monitoring screens, video cameras, telecommunications, emergency sirens and flashers and remote control equipment. Once the high-rise emergency rescue vehicle is linked to an extended roof-mount cantilever arm, it provides power for lifting the gondola that carry personnel and equipment up and down the exterior walls and roof of a high-rise building and monitors all activities.

Body:

The body is mounted to the rear frame of the high-rise emergency rescue vehicle and is equipped with an electric generator that is powered by the vehicle's transmission power take off. The body is outfitted with a turn-table frame and an electric/hydraulic system that extends the frame for positioning the gondola, in or out. The body is equipped with an electric/hydraulic driven system that maneuvers a platform up or down for positioning the gondola. The body is also furnished with a continuous self leveling component for maintaining unit balance and an electric/hydraulic driven outriggers system for system stability. The body is constructed using a frame extension which moves in and out and a rear adjustable platform which raises and lowers the Gondola. The body, above the control room, is fitted with spot lights, emergency flashing lights and antennas. The body also has a control room, draw-works section and transports the gondola and block.

Control Room:

The control room is operated by Operator I. The control room is a part of the vehicle body and is located directly behind the vehicle's cab. There are two entry doors, with bottom mounted retractable steps, on each side of the control room. The control room equipment is designed to perform mechanical maneuvers using different controls to operate the high-rise emergency rescue system. The control room is equipped with an operators chair, computers, video equipment, visual and digital monitors, first aid equipment, heater and air conditioning and first aid equipment. There are various hand control handles, foot control paddles and switches that control the movement of wenches, cables, braking systems and hydraulic motors which control the gondola and block.

Draw Works:

The draw-works section is positioned on the vehicle's body and is located between the control room and the gondola. The draw-works section provides hydraulic and electrical power to cable drums for connecting; a cable that is lowered from a roof-mount system, to a stabilizer drum in the draw-works section of the vehicle, fastened and pulled taut; a block lift cable drum that lifts a sheaved block from the vehicle and locks it to an extended roof-mount cantilever arm located on the top of a high-rise building; and two gondola lifting drums, working simultaneously, that raise and lower the gondola on the outside wall of a high-rise building.

Gondola:

The gondola is an elevator type cabin which provides protection during transportation for personnel and equipment up and down the outside wall of high-rise buildings. The gondola provides enough interior standing space for eight fully equipped firemen while traveling up and down the outside walls of a high-rise building. The gondola is operated by a control room operator or by an operator located inside the gondola. The gondola is equipped with three sliding, controlled locked, doors that pulls open and pushes closed. Two of these doors are mounted on the sides of the gondola and are used for passengers to enter or exit. There is a sliding door mounted to the right front of the gondola and is used for mounting or dismounting to the interior rooms, or to and from, the roof of a high-rise building. The gondola is equipped with video cameras that monitor the occupants. The gondola is equipped with a water spraying nozzle that is attached to the high-rise buildings water stand-pipe. The gondola provides an extended walk-way platform from its bottom front, facing the building, for entering or exiting the interior or roof of a high-rise building. The gondola is equipped with a brake system, guidance systems, emergency tools, window breakers, fire extinguishers, and other fire fighting equipment.

Block:

The block is a mechanical piece of equipment positioned on top of the gondola. The block is equipped with two or more large sheaves that are strung with lifting cables that extend from cable lifting drums, mounted on a ground vehicle, to fitted lifting devices attached to the top of the gondola. The block is raised by a ground vehicle, hydraulic lifting drum, and attached to an extended cantilever arm, a part of a roof-mounted cantilever system. The block is provided with a stinger or coupling locking mechanism that attaches and locks the block to the roof-mount cantilever arm.

Cantilever Roof-Mount System:

The cantilever roof-mount system is a moveable, metal framed, piece of equipment that provides an extended, weight handling, cantilever arm that extends over the parapet of a high-rise building. The cantilever system retrieves a weight lifting, cable strung block, from a stationary ground vehicle, docks and locks it to an extended roof-mount cantilever arm. The roof-mount system is controlled, in part, by radio frequencies from the ground vehicle. Some of the frequency controlled functions maneuver the cantilever roof-mount system to various locations on top of a high-rise building. The roof-mount system also includes a camera which provides visual information to the operator located in the vehicle's control room.

BRIEF DESCRIPTION OF THE SEVERAL VIEWS OF THE DRAWINGS

A better understanding of the present invention may be had by reference to the following description when taken in conjunction with the drawings wherein:

FIG. 7 is an extended front view of the block's locking jaw mechanism attached to the block that is locked on to the cantilever arm and outlines the sheave placement inside the block and their position relative to the single tree lifting mount and lifting cables connected to the gondola;

FIG. 19 also displays the position for a water standpipe hose connection with a water spraying nozzle;

FIG. 12 presents the single lift unit mounted to the interior frames of the one stage lift system and shows the routed cables, sheaves and a hydraulic lifting cylinder with extended piston. Also, displayed are the cantilever arm and attachments, drums and their positions and various loads bearing beams. FIG. 12 further depicts the control weight guidance system attached to the block lift cable the stabilizer connected to a modified weight;

FIG. 13 shows the single lift unit mounted to the interior frames of the one stage lift that is mounted to the frames of the two frame lift system. When viewing the bottom portion of FIG. 13 drawing, note there are vertical and horizontal structural columns and beams which are used to construct the two stage lift system. FIG. 13 also displays stabilizing outriggers with pods mounted to the front vertical columns of the two stage lift system. FIG. 13 shows four retractable wheels, wheel wells with springs and shaft, hydraulic cylinder and piston. Also, displayed in FIG. 13 is a ladder means;

FIG. 14 shows the room-mount attached to the building's joist and a counterweight that is attached to its rear. Also displayed is a retrievable platform mounted under the gondola floor. Shown, also, are the stabilizer cable, front, side lift cables and rear block lift cable;

FIG. 15 allows a view of the conductor line cable and its passage through the male and female connectors to the coupling of the block for electrical use;

FIG. 16 also allows a view of the stabilizer cable, left and the main lift cables, center and the block lift cable, back, in their respective cable guides located on the sides of the block;

DETAILED DESCRIPTION OF THE INVENTION

Figure 1:
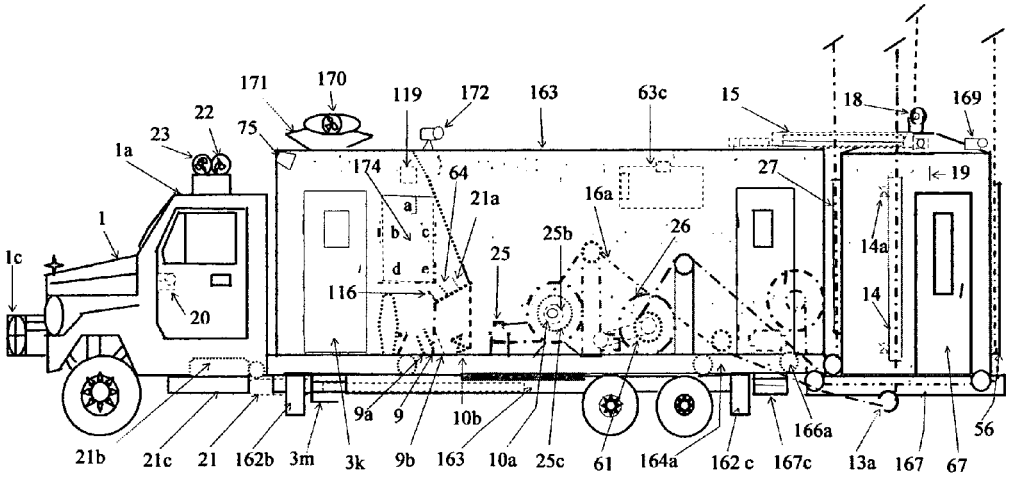
FIG. 1 is a right side view of the emergency rescue vehicle outlining the vehicle cab, body, control room, draw-works section, gondola and block.
Figure 2:
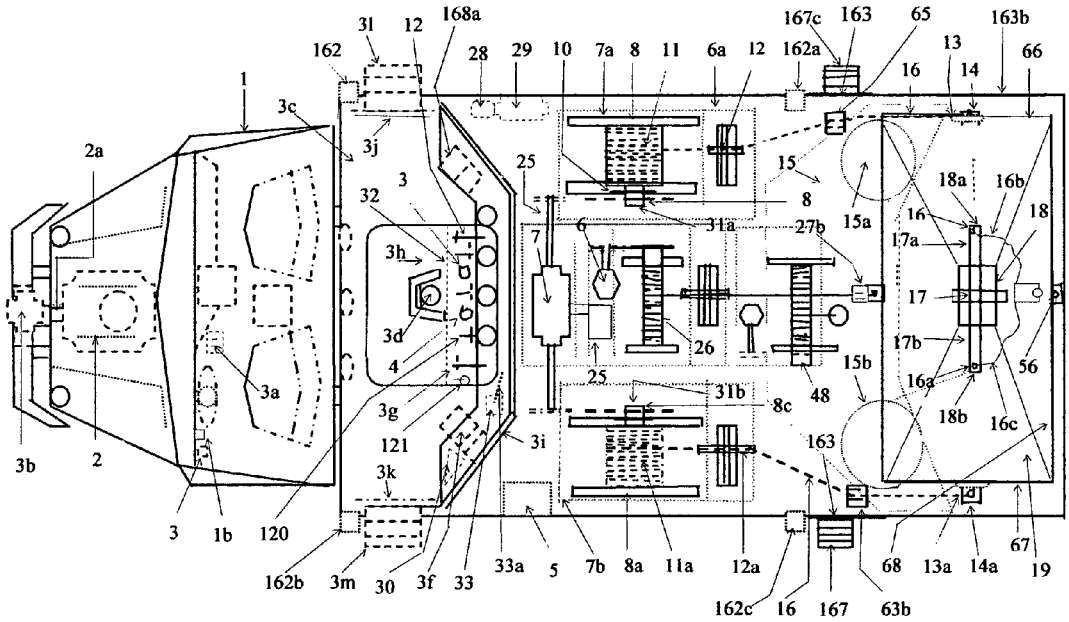
FIG. 2 is a overview of the emergency rescue vehicle outlining the vehicle cab, body, control room, draw-works section, gondola and block.
Figure 3:
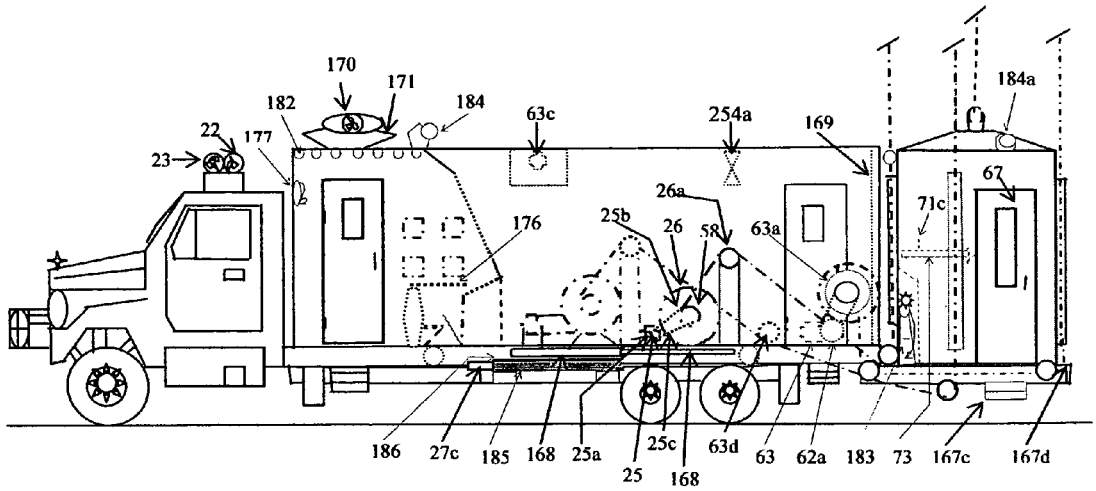
FIG. 3 is an extended view of FIG. 1 of the emergency rescue vehicle outlining the vehicle, cab, body, control room, draw-works section, gondola and block.
Figure 4:
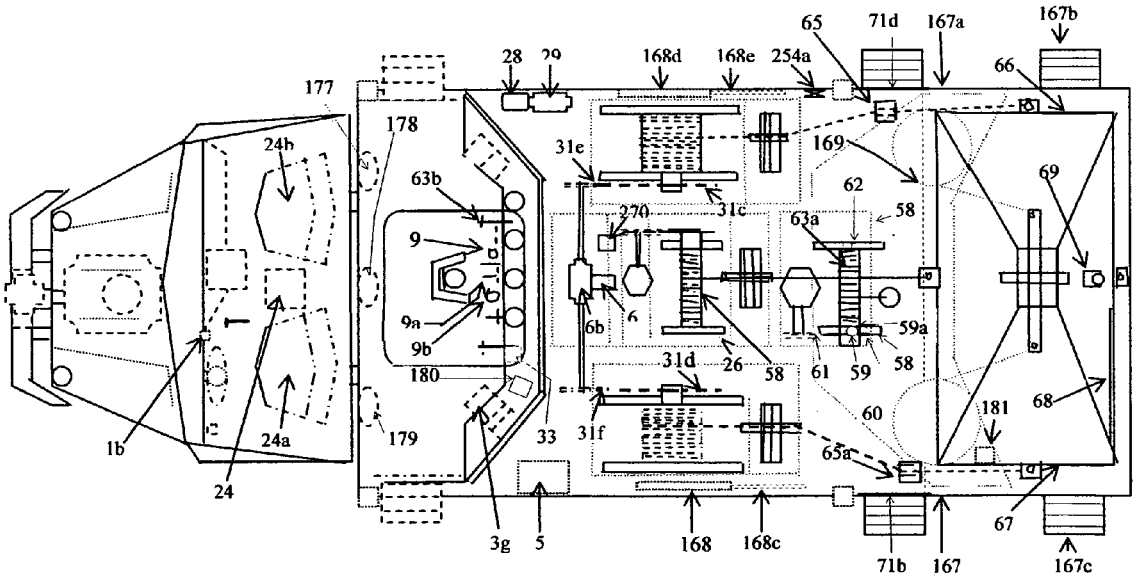
FIG. 4 is an extended view of FIG. 2 of the emergency rescue vehicle outlining the vehicle, cab, body, control room, draw-works section, gondola and block.
Figure 5:
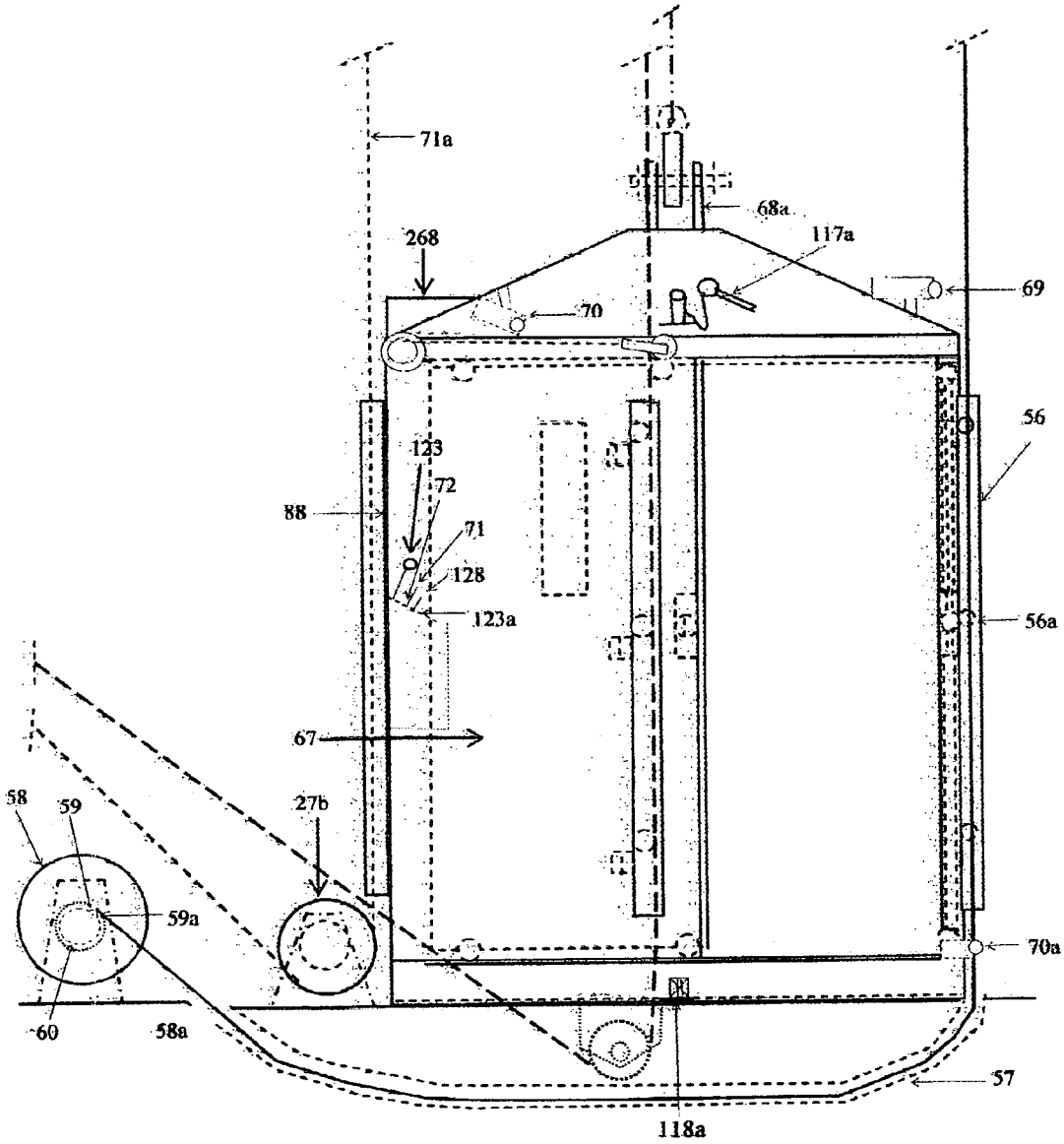
FIG. 5 is a right side view of the gondola stationed on the rear platform of the vehicle bed and displays the front stabilizer connection, left gondola lifting cable, right lifting cable and back block lift cable each placed in their respective guides.
Figure 6:
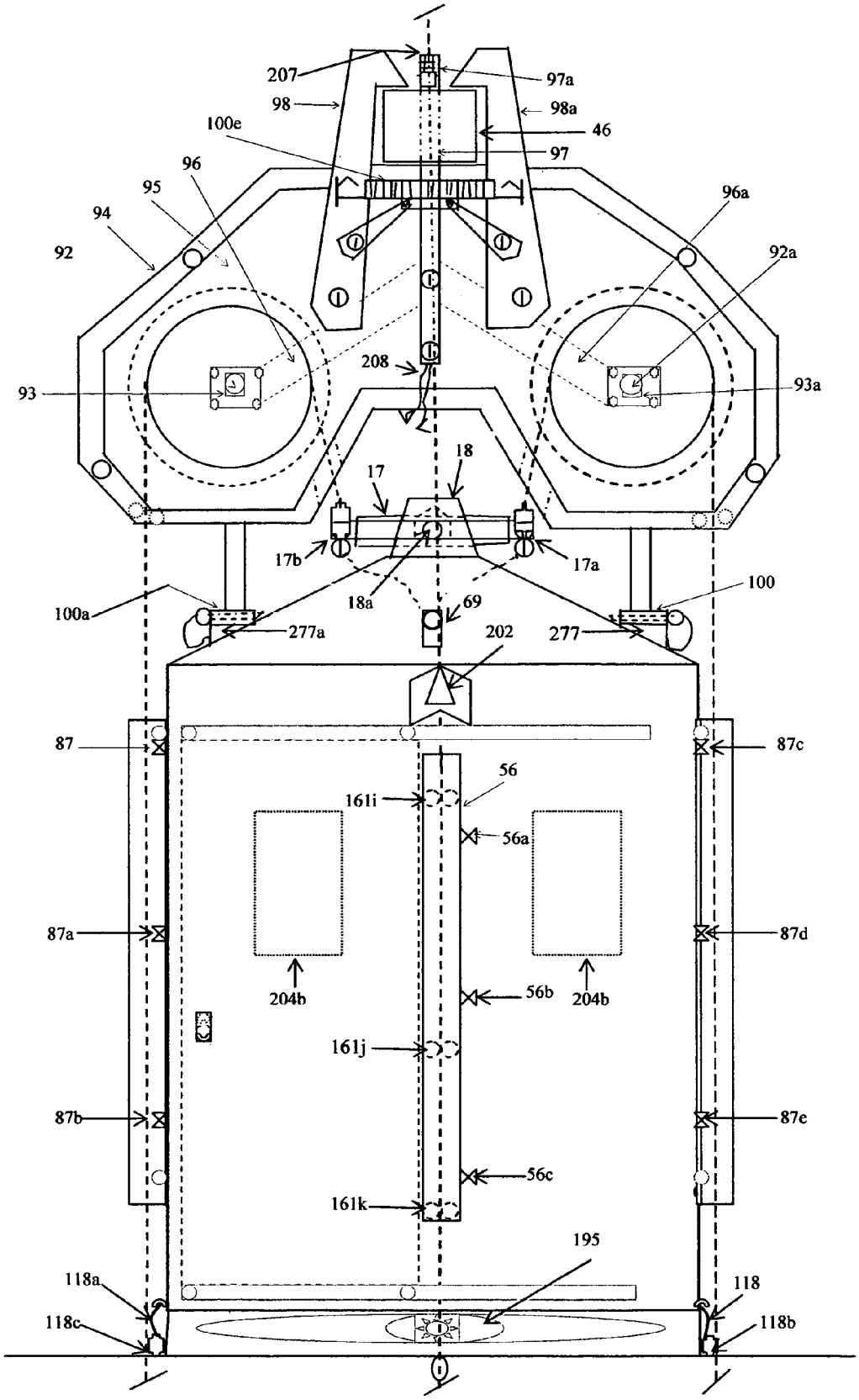
FIG. 6 is a front view of the block's locking jaw mechanism attached to the block that is locked on to the cantilever arm and outlines the sheave placement inside the block and their position relative to the single tree lifting mount and lifting cables connected to the gondola.

A more detailed understanding of the present invention may be had by reference to the following detailed description when taken in conjunction with the drawings wherein:

FIGS. 1, 2, 3 and 4—Vehicle:

The vehicle 1 is a large commercial truck with an extended rear frame that is custom designed using a turn-table frame for positioning and hydraulic outriggers for stabilization. The vehicle consists of four areas, each performing different functions:

Vehicle 1 and cab 1*a* houses all the electric and hydraulic controls necessary for operating the high-rise emergency rescue egress system. All operational switches to operate the communication and emergency lights 22 and sirens 23 are located on a console 24 mounted between the vehicle 1, cab 1*a*, driver seat 24*a* and passenger seat 24*b*. The ignition switch 1*b* and other hydraulic controls, and kill switches, are located on the dashboard inside cab 1*a*. When actual emergency operations begin all controls and functions are transferred from the cab 1*a* to the control room 3 for operation. A hydraulic pump motor 3*b* is mounted on the front bumper 1*c* of the vehicle 1. The main hydraulic pump motor 3*b* is engaged 3*a* inside of cab 1*a*. The vehicle's 1 engine 2 powers and rotates crankshaft 2*a* transfers power to the main hydraulic pump 3*b*. The hydraulic pump motor 3*b* supplies power to a hydraulic motor 6 in the draw-works section 6*a*, that operates the cabled drums 8 and 8*a* that lifts and lowers the gondola 19.

FIGS. 1, 2, 3 and 4—Control Room:

The control room 3*c* is located rear of the vehicle's 1 cab 1*a*. Hydraulic power to operate control room 3*c* is supplied by a power-take-off system 21 mounted on the vehicle 1, transmission 21*b*. This power-take-off 21 control 4 operates the transmission hydraulic pump 28 that provides power to hydraulic motor 28*a*, that in turn, operates an electric hydraulic generator 29 and other required electrical powered systems, such as activating the turn-table or fifth-wheel 185 and 186 movement of the truck body 163*a* and also operates the body levelers 162, 162*a*, 162*b* and 162*c*. The Operator I am seated 3*d* in front of the operator control room 3*c*, and perform all functions necessary to operate the entire system from this location. The control room 3*c* is equipped with an electric control panel 30 that supplies electrical current to audio 175 and video equipment 168*a*. The control room 3*c*, control panel 3*d* is equipped with a kill switch 121 that stops all movement of the high-rise rescue system once activated or compressed. Operator I, by pressing down on the red standup button 121*a*, control room 3*c* halts all movement of the entire high-rise rescue system, except for the manual s brakes 9, 9*a*,

9*b* and 10, 10*a* and 10*b*. The operator room 3*c* consists of five television monitors 174, 174*a*, 174*b*, 174*c* and 174*d* and operation gauges 3*a* and 3*e*, computer 3*f* and control levers 3*g*. The operator room 3*c* has a large window 3*h* in the ceiling and a large window 3*i* facing the rear of the body 163*a*. The system's Operator I can view the draw-works section 6*a*, the gondola 19 and monitor activities above. Voice activated communication helmets 177, 178 and 179 are stored in the operator room 3*c* for Operator I, II and III. The control room 3*c* is equipped with a chemical warfare detector monitoring system 180. The gondola 19 is equipped with a chemical detector 181 that transmits chemical readings to the control room 3*c* chemical monitor 180. The control room's 3*c* roof 182 is supported by reinforced steel to protect its occupants from falling debris.

FIGS. 1, 2, 3 and 4—Draw-Works Section:

The draw-works section 6*a* is located between the operator's room 3*c* and the gondola 19, in the vehicle 1 truck body 163*a*. The draw-works section 6*a* is activated using controls 3, 3*a*, 3*b* and 20 located in the vehicle 1, cab 1*a*. Once these controls are activated Operator I in control room 3*c* assumes full responsibility for controlling the entire high-rise emergency rescue operations using controls 3*e*. These controls start the power take-off drive 21 that is attached to vehicle 1, transmission 21, in turn, controls the electric generator 28, block lift drum 26 and the stabilizer drum 63*a*. Other mechanical operating components of the stabilizer cable drum 63*a* are the stabilizer cable tension drum sprocket 60, chain 61, axle 62, small sprocket 62*a* stabilizer cable tension drum hydraulic motor 63 and brake control 63*b*. The major operating components for the block lift are the hydraulic motor 25, motor drive shaft 25*a*, drum sprocket 25*b* and drive chain 25*d*. The draw-works section 6*a* consists of two large cabled drums 8, left and 8*a*, right. These drums 8, left and 8*a*, right are operated from the operator room 3*c*. The drums are powered by the vehicle's 1 front mounted hydraulic pump 3*b*. A hydraulic fluid reservoir 5, supplies hydraulic fluid to hydraulic motor 6 that rotates a dual axle transmission 7 that is powered by sprocket 31*c* and 31*d* and chain 31*e* and 31*f* to the main lifting drums 8, left and 8*a*, right. The main lifting drums 8, left and 8*a*, right are mounted on structural steel frames 7*a* and 7*b*, respectfully, and use fleet angle compensators 7*a*, left and 7*b*, right to properly spool the cables on to the main lifting drums 8, left and 8*a*, right. The lift drums 8, left and 8*a*, right are spooled with sufficient conductor line cable 11, left and 11*a*, right to reach from the drums 8, left and 8*a*, right through main lift floor sheaves 13, left and 13*a*, right, the gondola 19 side guides 14, left and 14*a*, right and to the top of tallest building in any given city and back to the top of gondola 19 located at the rear of vehicle body 163*a*. The conductor cables 11, left and 11*a*, right are constructed steel cables with electrical wiring 16, left and 16*a*, right interiors. Electric slip rings 8*b*, left and 8*c*, right are mounted to the outside flanges 31*a*, left and 31*b*, right of the main lift drums 8, left and 8*a*, right which supply electrical power to the conductor line cables 11, left and 11*a*, right. The conductor line cables 11, left and 11*a*, right are routed through the systems block 15 and secured at fitting 16*b*, left and fitting 16*c*, right, on top of the gondola 19. These conductor line cables 11, left and 11*a*, right supply power from the vehicle's 1 generator 29 to the gondola 19 to operate the gondola 19 from the interior housing 71 of the gondola 19. The conductor line cables 11, left and 11*a*, right are used to supply other power to the gondola's 19 three interior or exterior cameras 169, 170 and 171. The main lift drums 8, left and 8*a*, right are equipped with disc brakes and calipers 10, left and 10*a*, right that are controlled by a disc brake foot paddle 10*b* mounted on the floor of control room 3*c*.

FIGS. 1, 2, 3 and 4—Body:

The body 163*a* of the high-rise rescue system consists of a large truck bed and is referred to as a body 163*a*. The body 163*a* is fastened to the rear frame 163 turntable or fifth-wheel 185 and 186 using frame mounting brackets 27*a*, 27*b*, 27*c* and 27*d*. The body 163*a* rotating turn-table and fifth-wheel 185 and 186 provides horizontal movement of the vehicle 1, body 163*a*, left and right 280 degrees. The part of the body 163*a*, closest to the vehicle's cab 1*a*, contains an operator's room 3*c* and is the control center for the high-rise emergency rescue egress system. The operator's room 3*c* provides an adjustable swivel chair 3*d* for Operator I, computer controls 3*f*, search lights 184, emergency flashing lights 170, control room air conditioning and heater 171, first aid 278, oxygen 279, fire extinguisher 183, brake controls 9, 9*a*, and 9*b*, hydraulic controls 4, gauges 3*e*, and switches 3*g*, audio 176, video 168*a*, number four camera 172, attached top of vehicle body 163*a*, cabin, with pan and tilt capabilities and other functional devices that assist the Operator I in operating the high-rise system. The operator room 3*c* has entrance doors 3*j* and 3*k*, with glass, on each side of the body 163*a*. On the exterior of the body 163*a*, under these doors are retractable steps 3*l* and 3*m*, for entering and exiting the operator room 3*c*. The operator's room 3*c* is equipped with a tinted safety proof glass window 3*h* for viewing operation's overhead and a front window 3*i* with a tinted safety proof glass for viewing the draw-works section 6*a* and gondola 19 operations to the rear section of the body 163*a*. These windows 3*h* and 3*i* allow the Operator I to view all the operating components of the system while being operated and to view the gondola 19 as it ascends or descends the outside walls of a high-rise building. The body 163*a* houses the draw-work section 6*a*. The draw-work section 6*a* is located in the center of the body 163*a*. This section contains two main lift drums 8, left and 8*a*, right, a stabilizer drum 45 and a block lift drum 26 and their various fleet angle compensators 12 and 12*a*, monitoring devices 174, 174*a*, 174*b*, 174*c* and 174*d*, operating sprockets, chains, pulleys, sheaves, brake systems, hydraulic fluid storage tanks and other systems paraphernalia. The main lift drums 8, left and 8*a*, right are spooled with conductor line cables 11, left and 11*a*, right that raise and lower the gondola 19. The rear end portion of the body 163*a* contains the gondola 19 that transports people and equipment up and down the exterior walls of a high-rise building. The rear area of the body 163*a* that supports the gondola 19 is equipped with a raising and lowering platform section 169, which allows Operator I to raise and lower the rear end of the body 163*a* and to position the gondola 19 up or down. The body 163*a* provides four outrigger leveler's 162, 162*a*, 162*b* and 162*c* on each of its four corners. These levelers maintain constant leveling as the body 163*a* is being rotated. The body 163*a* provides a slide rail system 164, left, 164*a*, right and a movable platform 169, where the gondola 19 is positioned, at the rear of the body 163*a*, or bed. FIG. 1—These floating side rail systems 164 and 164*a*, travel on steel casters or rollers 166 left side, rear, 166*a* right side, rear, 166*b* left side, front and 166*c* right side, front, allows Operator I to use controls on control panel 3*g*, to activate hydraulic cylinder 168, right side and hydraulic cylinder 168, left side, which moves hydraulic piston 168*c*, right side and hydraulic piston 168*d*, left side, that moves the rear body 163*a*, moveable platform 169, horizontally, in and out, to position the gondola 19, near or far, from the building wall. The body 163*a* is designed so that the farthest portion opposite the operator's room 3*c* is open end 167*d*. This open end

167*d* of the body 163*a* allows for positioning the gondola 19 and provides access for Operator II to make necessary connections and disconnections of cables and various operational devices located on the exterior of the gondola 19, the stabilizer drum 45 and the block lift drum 26. The rear of body 163*a* provides two retractable steps 167*b* and 167*c* located on the underneath side of the body frame 163 that allow occupants to enter and exit the gondola 19 when located on the ground vehicle 1. The body 163*a* provides two doors 163*b* left and 163*c* right for entering and exiting to the draw-work section 6*a*. These doors are located immediately above the steps 167*b* and 167*c*, listed above, and are equipped with transparent safety glass, at eye level.

Figure 7:
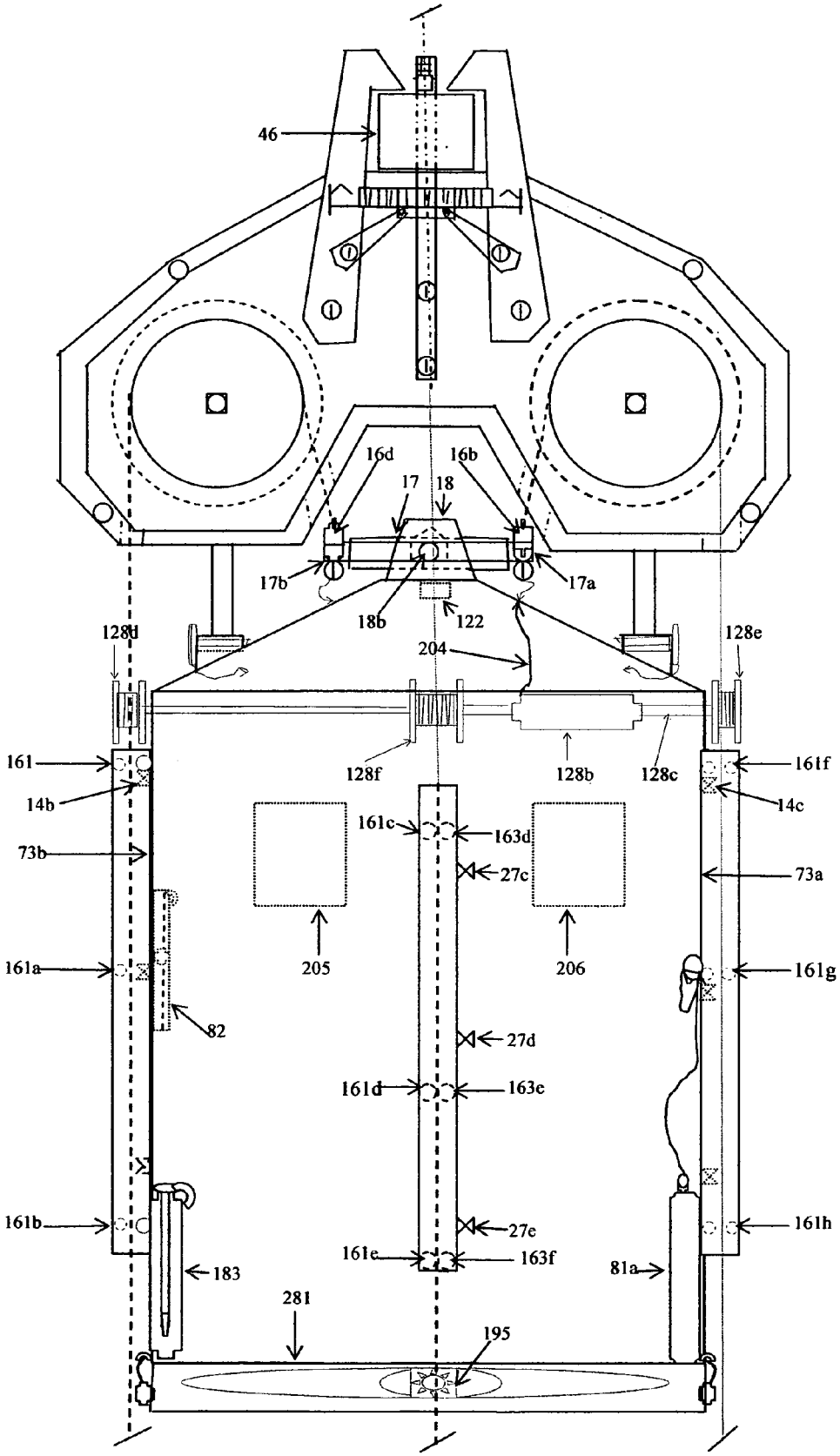
FIG. 7 further displays the sheave location and routes designated for the aforementioned cables.
Figure 8:
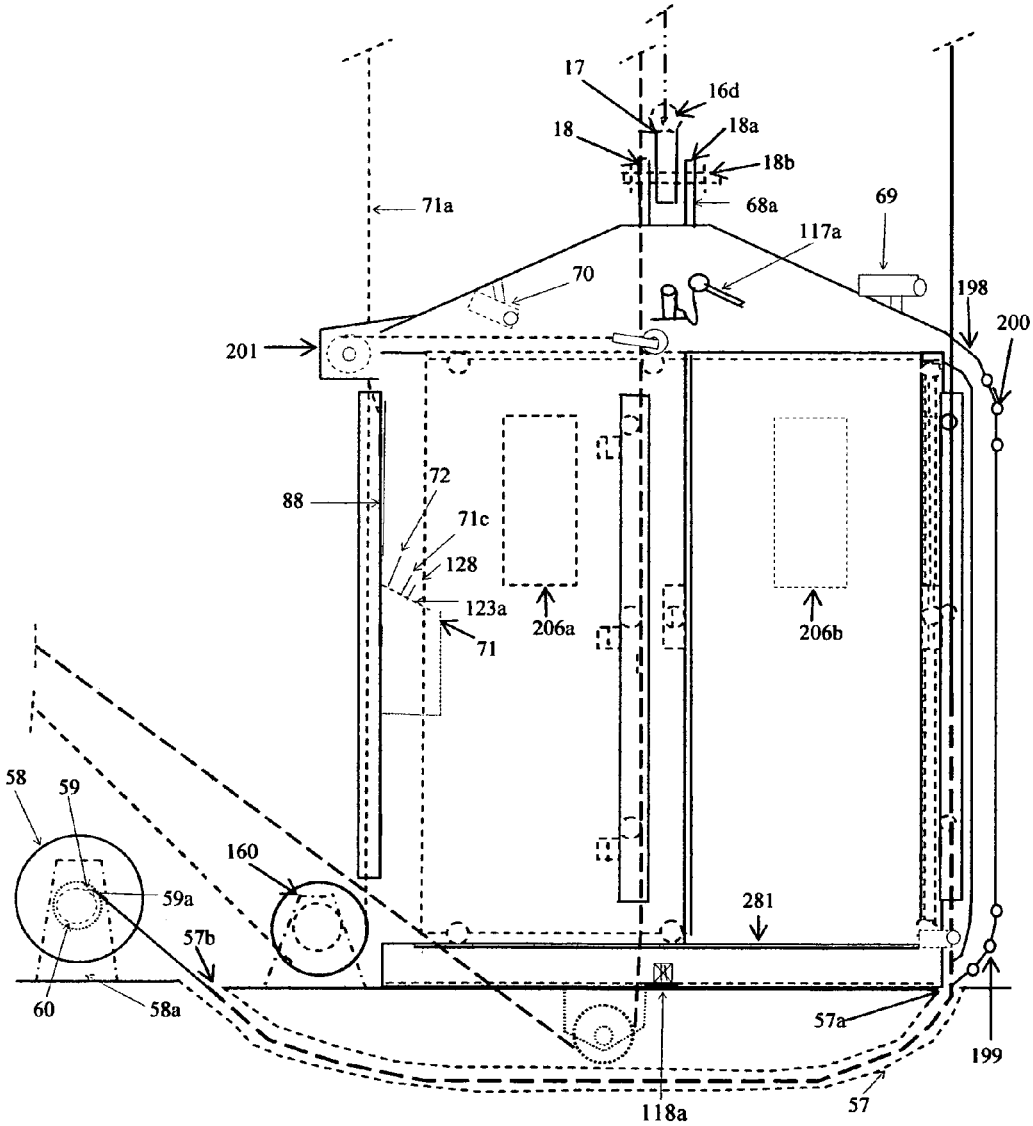
FIG. 8 is an extended view of the gondola's right side positioned on the rear platform of the vehicle body. This FIG. 8 view displays the gondola's top lifting attachment, strategic cameras locations, front slide rails and rollers, position of the gondola angle positioning drums, cables and sheaves, the gondola interior operations panel and the gondola roof mount block connectors.
Figure 9:
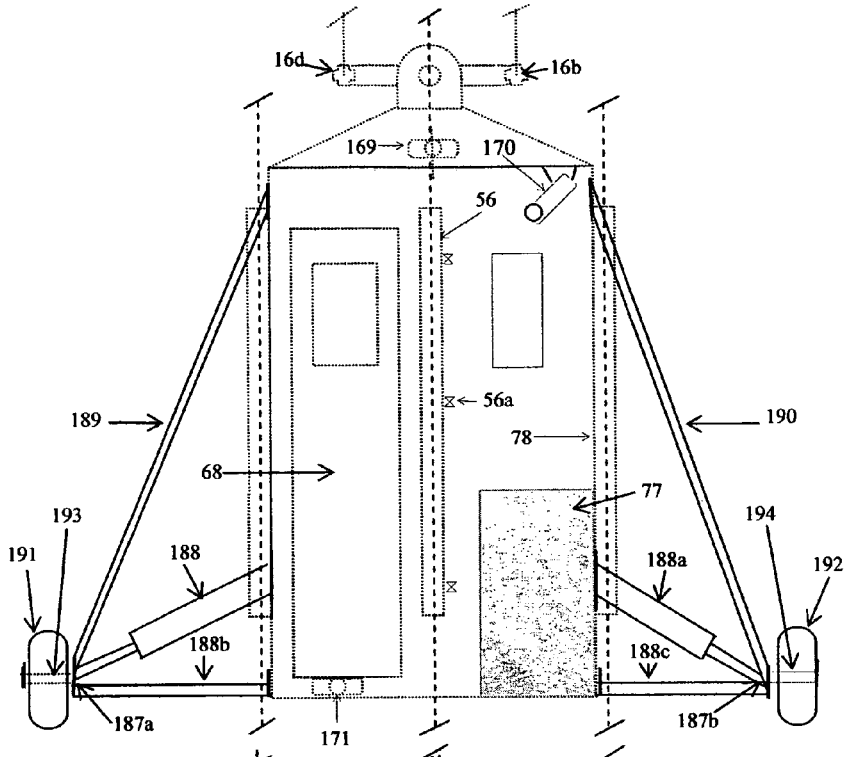
FIG. 9 is a front view of the gondola displaying the left and right sides of the exterior wall percussion units attached to the gondola.
Figure 10:
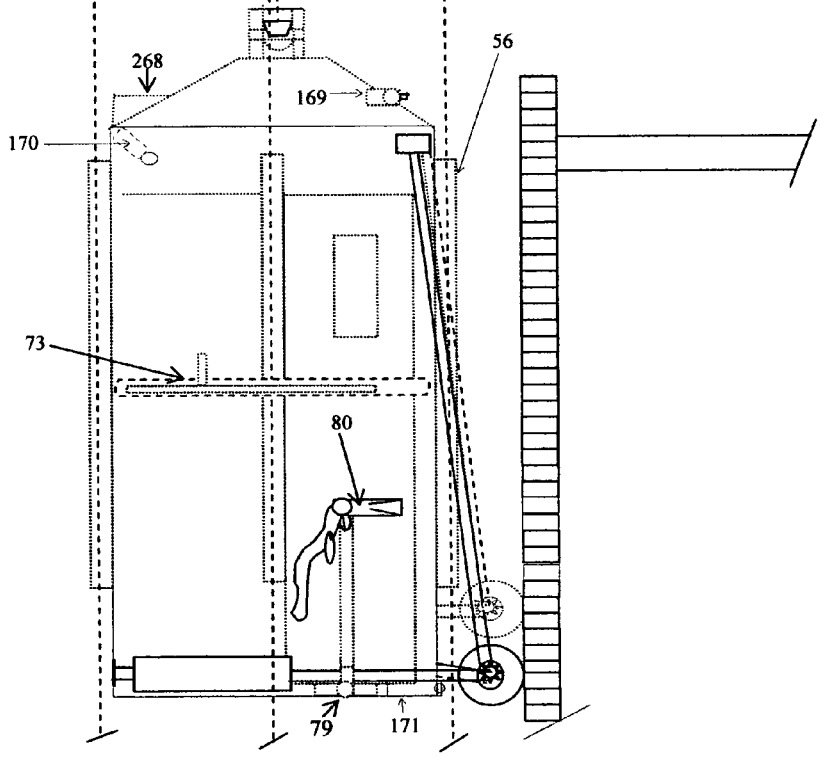
FIG. 10 is a right side view of the gondola showing its position relative to a building wall.

FIGS. 1, 2, 3, 4, 5, 6, 7, 8, 9, 10 and 14—Gondola:

The gondola 19 is similar in appearance to an elevator car. The gondola 19 is capable of transporting eight or more firemen and equipment up and down the exterior wall of a high-rise building. When not in use, the gondola 19 is positioned and stored on the rear of vehicle 1, body 163*a*. When all systems are in the rescue mode gondola 19 is driven by control lever 120, control room 3*c* or from the interior of gondola 19, control lever 128, located on control panel 123*a* of gondola 19. There is an emergency stop switch 123, located on gondola 19 control panel 123*a*, that halts all mechanical functions, if required. The gondola 19 is equipped with exterior cable guides 56*a* and 27 situated on the front center and front rear of gondola 19 and guides 14 left, center and 14*a*, right center, sides of gondola 19. These gondola cable guides have protective rollers or bearings 161, 161*a* through 161*k* and 163*d*, 163*e* and 163*f* which protects the stabilizer cable 47, the block lift cable 51 and the main lift cables 16, left and 16*a*, right from being damaged during movement of the gondola 19. These guides, 56*a*, 27, 14 and 14*a* are opened and closed using hinged latches 14*b*, 14*c*, 27*c* and 56*a*. The gondola 19 is designed to travel at different angles along the exterior face of a high-rise building wall and has roof access capabilities. Operator I, in control room 3*c*, when using lever 120 maneuvers gondola 19 to different angle positions on the exterior face of a high-rise building wall or operator I positions himself inside of gondola 19, and uses control panel 123*a* control lever 128 to manipulate or start the gondola 19 to different angle positions on the exterior wall of a high-rise building. The angle control system 128 is equipped with a covered housing 201 on the back, top side, of gondola 19. FIG. 7—Inside of the covered housing 201 is an angle drive motor 128*b* that is supplied electrical alternating current 204 from the main lift cables 16, left and 16*a*, right, electrical fittings 17*a* and 17*b* that turn drive shaft 128*c* that rotate three miniature cable drums 128*d*, 128*e* and 128*f*. Each of the three cable drums are spooled with small leader cables. Leader cables 128*d* and 128*e* are fitted by small sheaves 128*h* and 128*i*, respectively, to the main lift cables 16*a*, left and 16*b*, right. The small leader cable 128*f* is fitted to the block lift cable 71*a*. When vehicle 1 is positioned at an angle from a high-rise building operator I, using selected angle controls will release leader cables or retrieve leader cables to position the gondola 19 at a desired location on the exterior wall of a high-rise building. FIG. 8—The gondola 19 has two sliding doors 66, left and 67, right, with eye level windows 206*a* left and 206*b*, right. Positioned on the front, right side of the gondola 19 is one sliding door 68, with an eye level window 204*b*. There is an eye level window 204*a* on the front side of the gondola 19, opposite the door window 204*b*. There are two windows alongside 205, left and 206, right, located at eye level on the back side of the gondola 19. The interior walls of the gondola 19 are lined with fire proof insulation 77 and protected with aluminum siding 78 which is riveted. The gondola 19, cable guides 14, left and 14*a*, right are laced or encased with conductor line cables 16, left and 16*a*, right which travel up to, and threaded through, block 15 and back down to the top of the gondola 19 which are attached to a single tree lifting device 17 installed on top of the gondola that is used for lifting the gondola 19 up and down. The single tree lifting device 17 is connected to a designed steel fitting 18 by a single tree attachment lifting shaft 18*a*. The single tree 17 is equipped on each end with mounting attachments 17*a* and 17*b* that is part of the single tree lifting device 17. Attached to the ends of 16*b*, and 16*d* are certified lift fittings 18 and 18*a* that connects to the mounting attachments 17*a* and 17*b*. The top of gondola 19 is also used for storing block 15 when block 15 is not in use and is equipped with a gondola 19 height sensor 122 that senses the gondolas speed and position that prevents the gondola 19 from a sudden collision with the block 15 during operation. Most materials used to manufacture the gondola 19 are fire resistant. The interior of the gondola 19 houses a water standpipe connection 79, water pressure stand-pipe nozzle 80, oxygen 81*a*, fire extinguisher 80, first aid kit, communication 175 and video equipment 168*a*. Mounted on the roof of gondola 19 are two spot lights 184*a* that is maneuvered from the interior of the gondola 19. The interior of gondola 19 is equipped with manual operating electric hydraulic controls 71. An operator, stationed inside the gondola 19, can operate and maneuver the gondola in the same manner that Operator I in control room operator 3*c* does. The maximum load for gondola 19 is controlled by inline hydraulic bypasses 270. Should the gondola's 19 allowable weight limits exceed its set weight perimeters the gondola 19, hydraulic lifting system 4, will automatically enter into an inoperable bypass mode. The gondola will remain in its current position and in an inoperable bypass mode until the pre-designated weight parameters are obtained. The gondola 19 is equipped on with building exterior wall percussion absorber unit, detachable, 187*a*, left side and building exterior wall percussion absorber unit, detachable, 187*b*, right side. These building exterior wall percussion absorber units 187*a* and 187*b* are mounted on each side, and to the front, of gondola 19. The building exterior wall percussion absorber units 187*a* and 187*b* provide stability to the gondola 19 as its cushioned impact tires 191, left side, and cushioned impact tire 192, right side, come in contact with the exterior wall 271 of the high-rise building. When the cushioned impact tires 191 and 192 make contact with the buildings wall 271, percussion absorber 188, left side, and percussion absorber 188*a*, right side, absorb the impact shock causes gondola 19 to retain stability while traveling up and down the walls of a high-rise building. The building exterior wall percussion absorber units 187*a* and 187*b* are reinforced using placement pieces, hinged support frame 188*b*, bottom left side, and hinged support frame 188*c*, bottom right side, hinged absorber brace 189, angled, left side, hinged absorber brace, angled, right side, percussion absorber axle 193, left side and percussion absorber axle, right side. It may not be feasible to use the building exterior wall percussion absorber units 187*a* and 187*b* due to exterior wall openings, such as recessed balconies, therefore, the building exterior wall percussion absorber units 187*a* and 187*b* are designed to be removed in these instances to avoid hanging, snagging or catching during ascent or descent operations. The gondola 19 is designed with two front slide rails 198, right front and front slide rail 198*a*, left front. The gondola 19 slide rails 198 and 198*a* are required for protecting the front cable guide 27 during travel up and down the exterior wall of a high-rise building and allow smooth traveling, without interference, when the slide rails 198 and 198*a* come in contact with the exterior wall of a high-rise building. The gondola 19, front slide rails 198 and 198*a* have designed rollers 199 and 200 installed on the face of the guide rails to eliminate drag should the rails 198 and 198*a* come in contact with the exterior wall of a high-rise building. The gondola 19 is equipped with a gyroscope 195. The gyroscope 195 is in the middle, and fixed firmly and securely, in a compartment, beneath the gondola 19 flooring 281, or tread plate deck. The gondola 19, mounted gyroscope 195, provide stability and avoids twisting and turning of the gondola 19 while being operated in high winds, or wind current conditions. The gondola 19 is held in place by hold-down latches 118 and 118*a* are secured to the floor hold down brackets 118*b* and 118*c* of the vehicles 1, bed 167*d* beside the outside walls 73*a* and 73*b* of the gondola 19. The gondola 19 is equipped with a laser guiding system 202 positioned beside front cable guide 27 and works in conjunction with laser guiding system 203 positioned on the under side of lock 15, block lift cable guide frame 160, to help maintain immovability during high wind or wind currents while traveling up and down the outside wall of a high-rise building. The gondola 19 guiding systems 202 and 203 are activated by gondola control panel 123*a*. By positioning the hold down latches 118 and 118*a* over the hold-down brackets 118*b* and 118*c*, and locking, gondola 19 is held in place and cannot be moved.

Figure 15:
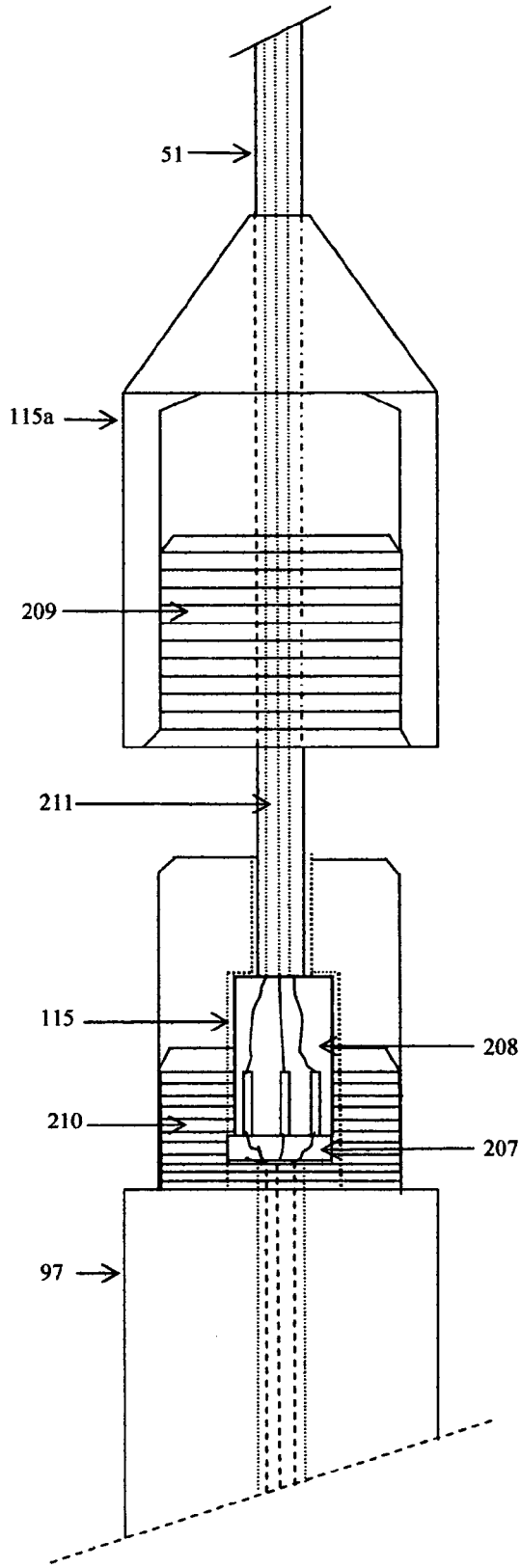
FIG. 15 is a designed connection that is affixed to the block lift cable for lifting the block from the roof of the gondola to the cantilever arm, locking and docking.
Figure 16:
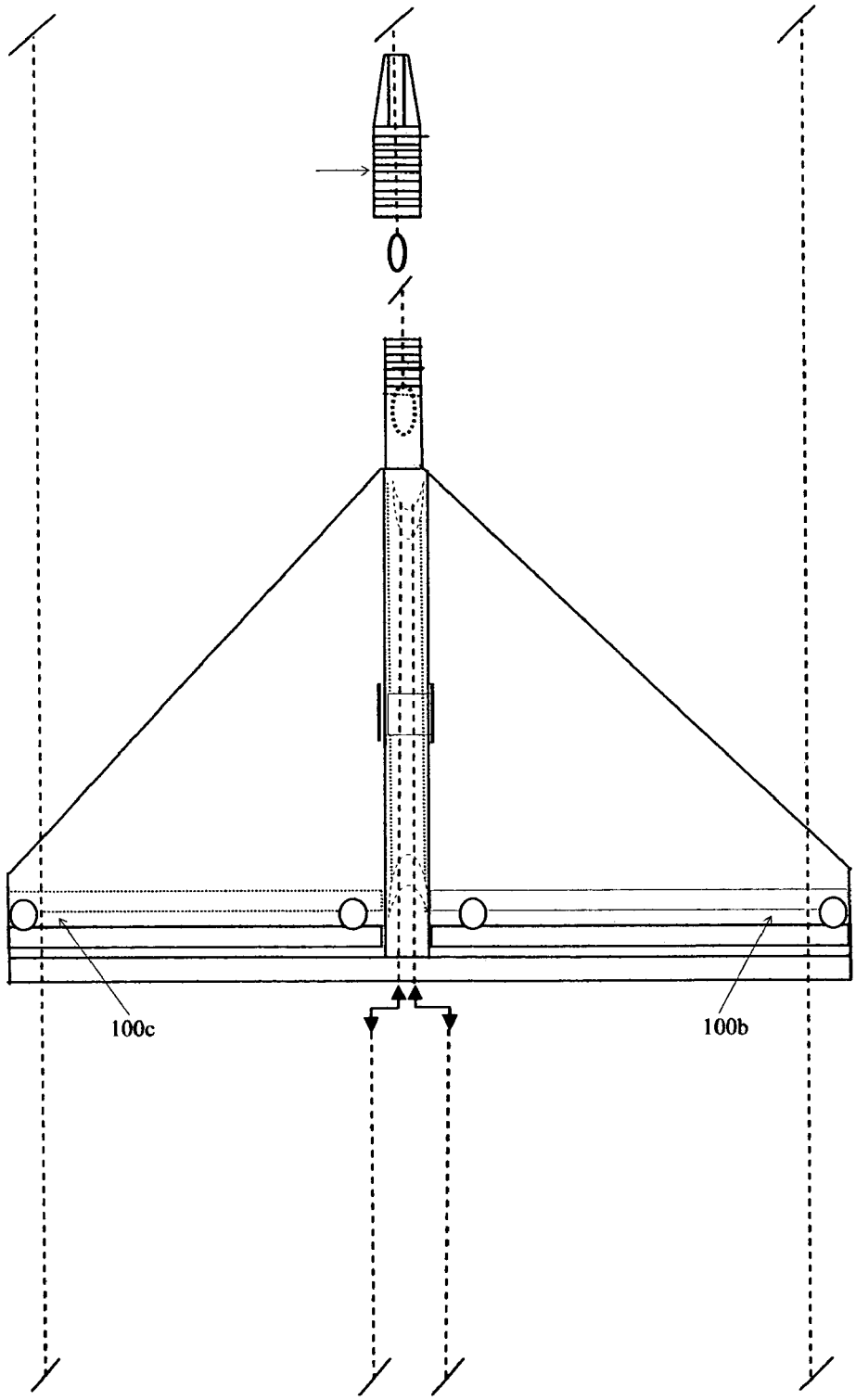
FIG. 16 is a left side view of the block and a disconnected female fitting that attached to the block male coupling.
Figure 17:
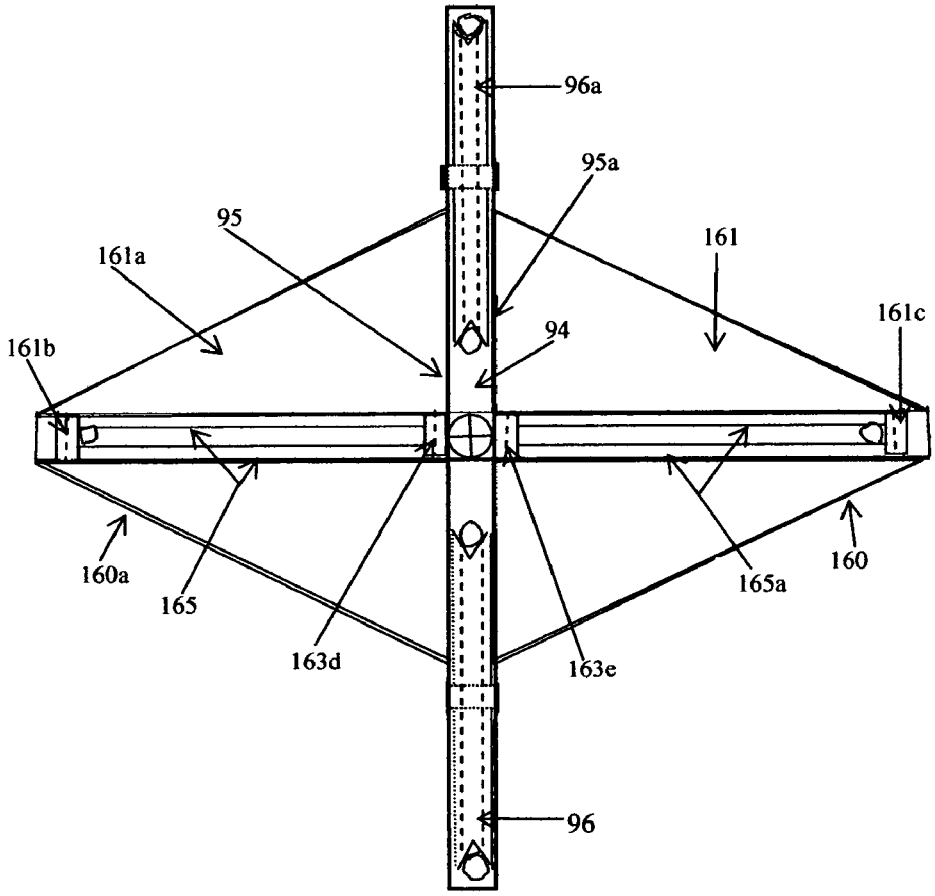
FIG. 17 is a top view of the block and illustrates the location of the main lifting sheaves, top and bottom, and the stabilizer cable guide, left, block lift cable guide, right and the stinger or block coupling, center.
Figure 18:
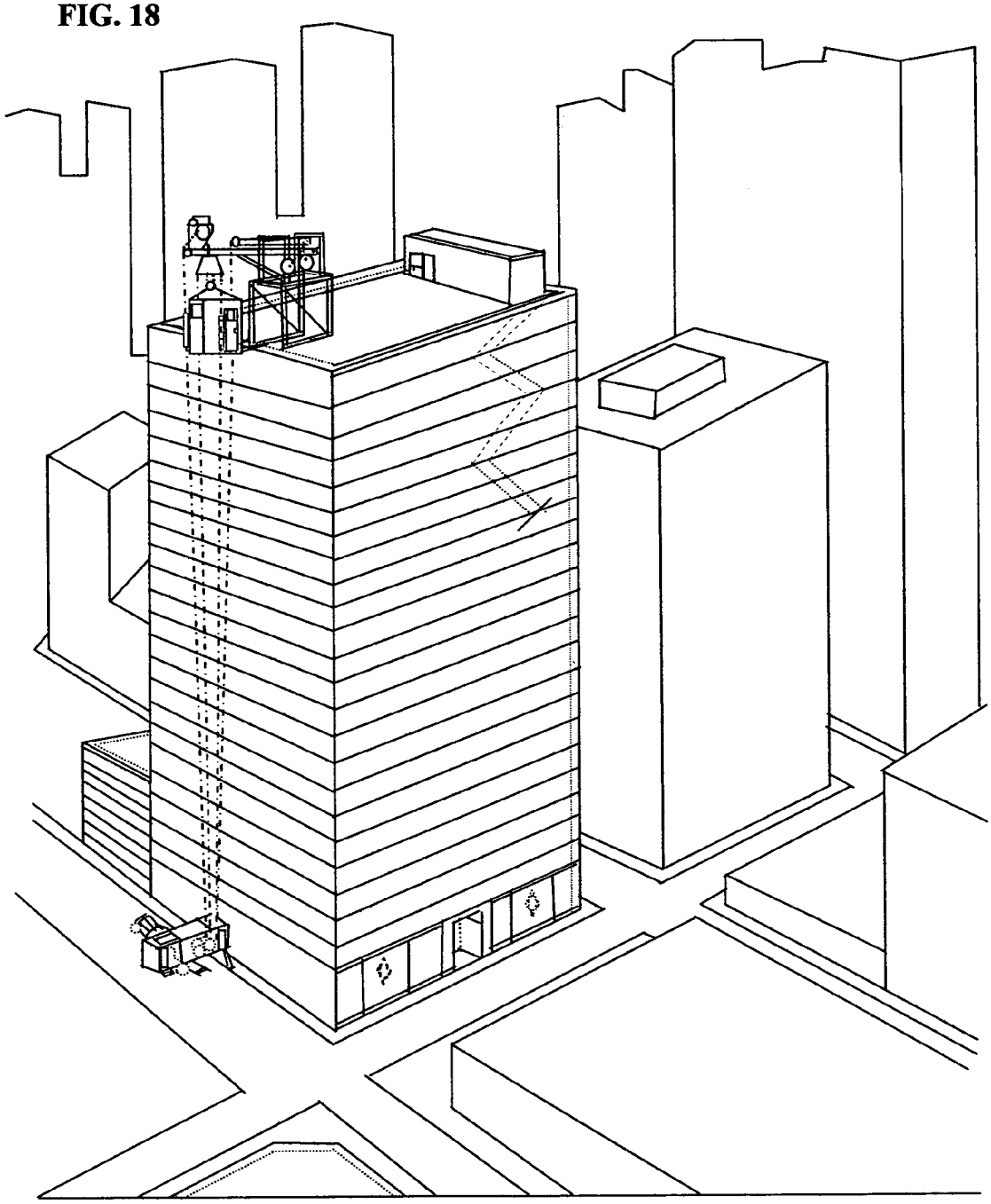
FIG. 18 drawing represent a bird's eye view of Reed' High-Rise Emergency Rescue Egress System installed on the side of a high-rise building, raised to its maximum height.

FIGS. 1, 2, 4, 6, 7, 14, 16 and 17—Block:

The block 15 is designed and constructed using structural steel, flat sheet metal, channel iron, metal supports, and sheaves, bearing shafts, machined fittings and bearings. The block 15 consists of a lifting stinger coupling 97 with a machined journal end 97*a* that connects to the female connector 115 that is connected to block lift cable 51 for lifting block 15 for docking and locking to cantilever arm 46. FIG. 15—The stinger coupling 97, machined end 97*a*, threaded exterior 210, electrical service outlet 208, male, and threaded interior 209, electric service outlet 207, female, when connected to threaded female connector 115, stabilizer cable 51, supplies alternating or direct electric current 211 to block 15 for distribution and service. The block 15, lift stinger 97 with machined journal end 97*a* support, on either side, locking jaw devices 98 and 98*a* that lock onto the roof-mount cantilever arm 46 when retrieved by block lift cable 51. The block 15 is structured to house two large sheaves 15*a* and 15*b*. These sheaves 15*a* and 15*b* are mounted side by side on the interior of the block 15. The conductor line cables 11, left and 11*a*, right, from the main lifting drums 8, left and 8*a*, right, are routed to the outside entrance of the sheaves 15*a* and 15*b*, over the sheaves and back to the gondola 19 single tree lift attachment 68*a*, located attached on top of Gondola 19. The block 15, when not in use, is stored, lying horizontally, on top of the gondola 19. While in the stored position the block 15 stinger connector 97 is pointed toward vehicle 1, cab 1*a*. Block 15 is secured to the top of gondola 19 using block lock brackets 100 and 100*a*, gondola roof housing brackets 277 and 277 and locking pins 117 and 117*a*. Block 15 serves the purpose, when being lifted by the block lift drum 26, of uncoiling 11, left and 11*a*, right, cables from the main lift drums 8, left and 8*a*, right, which are used to lift and lower the gondola 19. FIG. 17—illustrate that cable guides 161 and 161*a* are constructed to the front and back sides of block 15. These cable guides 161 and 161*a* control block 15 as it is lifted or lowered and prevents it from twirling or rotating. The block lift cable 51 and stabilizer cable 47, when positioned through the block roller guides 161 and 161*a*, are surrounded by protective rollers. The block cable guide 161 is mounted to the front, outside plate 95*a* of block 15 and has protective roller 161*c* mounted on the outside, end, and protective roller 163*e* mounted on the inside, end, of side protective roller guides 165*a*. The stabilizer cable guide 161*a* is mounted to the back side of the outside plate 95 of block 15 and has protective roller 161*b*, mounted to the outside, front, of protective cable guide 161*a* and protective cable roller 163*b* is mounted to the inside, end, nearest the outside plate 95 of sides protective roller guides 165. The height of the block 15 dictates the distance the Gondola 19 may be lifted by the main lift drums 8, left and 8*a*, right. It is not required that block 15 be docked and locked to the cantilever arm 46 to raise or lower the gondola 19.

Figure 11:
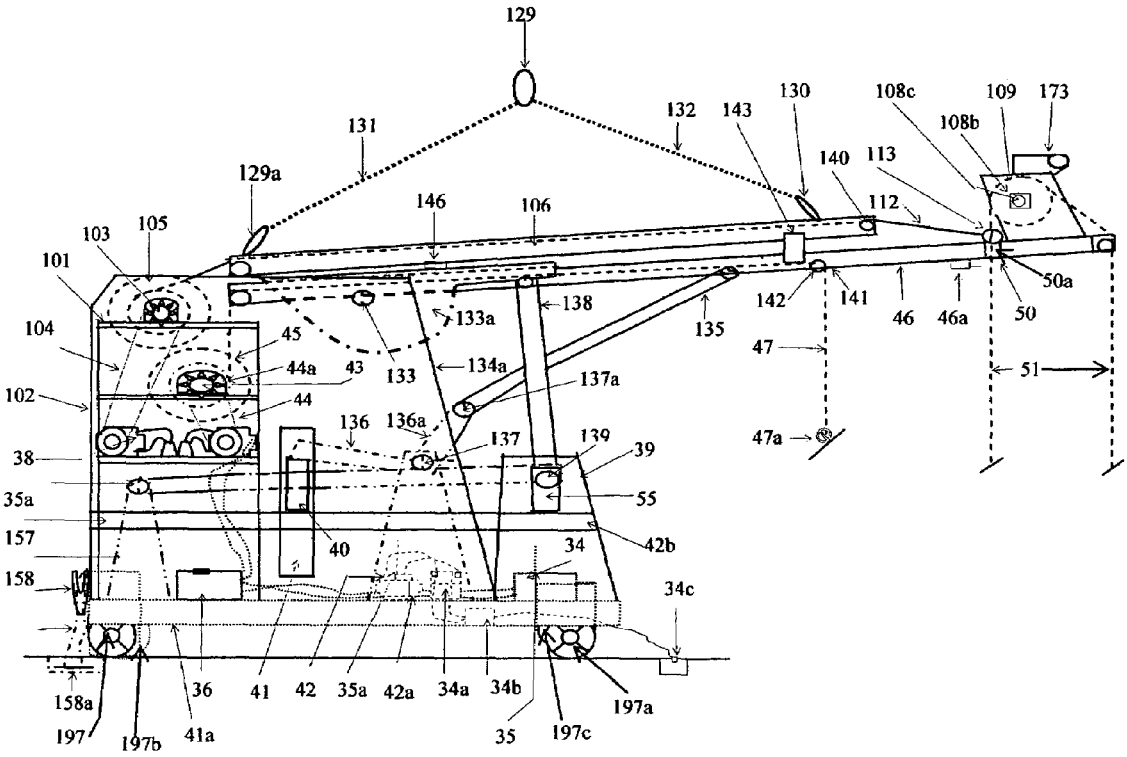
FIG. 11 is a drawing of a single roof-mount cantilever system. This drawing outlines the primary functional pieces of the apparatus. Shown in FIG. 11 are the cantilever arm, end mounted block lift sheave, pan and tilt camera location, helicopter lifting device, hydraulic systems, stabilizer cable drum, block lift drum, signaling systems, structural framework, floor mount, electric receptacles and wheels. Also, shown, attached to their respective drums, in FIG. 11 are the stabilizer cable and block lift cable.

FIGS. 11, 12, 13 and 14—Cantilever:

The cantilever 41*a* is a roof-mount structural steel unit designed to function electronically and mechanically, support its weight, the weight of lifting cables 16 and 16*a*, block 15, gondola 19, gondola equipment and a polarity of uniformed emergency responders or occupants. The cantilever roof-mount system provides steel installation mounts and movable cable drums for stabilizer cable 47, block control cable 112, and block lift cable 51. FIG. 11—The stabilizer beam 106 is situated above the block lift beam 46 and attached by 143, left rear, 143*a*, right rear, space mounts and 146 front left and 146*a*, right front, space mounts. The stabilizer cable 47 is lowered to vehicle 1 and acts as a stabilizer for gondola 19. The block control cable 112 controls block lift cable 51, and positions it over, and retrieves it from, cantilever sheave 109 mounted on cantilever arm 46. The cantilever arm 46 is equipped with number 5 camera that is arranged to the top of cantilever sheave frames 108 and 108*a* and has pan and tilt camera capabilities. The block lift cable 51 is used for lifting block 15 from the top of gondola 19 and locking it to cantilever arm 47. These cables become an integral part of the high-rise emergency rescue egress system when maneuvering the gondola 19 up and down the exterior wall of a high-rise building. The cantilever roof-mount system 41*a* maintains a ten to one safety factor that is required by federal regulations to transport people. The cantilever housing 41*a* is manufactured using structural steel support and lifting sections 272 and 273, stabilizer cable drum 45, block cable drum 105 and two hollow, square, steel beams, block lift beam 46 and stabilizer cable beam 106 and cantilever sheave 109. Cantilever beam 106 is located on top of cantilever beam 46. Cantilever beam 46 is used as a support for cantilever beam 106 which acts as a positioning guide for the stabilizer cable 47. Cantilever beam 106 is used in various ways to deliver and retrieve the block lift cable 51 to and from vehicle 1, stationed on the ground. The cantilever beam 46 supports the block indicator position sensor 46*a* that maintains locking distances between the cantilever beam 46 and the block 15 while in the docking and locking mode. The cantilever beam 106 is held in place above cantilever beam 46 by welded steel braces 146, 146*a*, 143 and 143*a*. The cantilever roof-mount system 41*a* allows for two, or more, electrical hydraulic driven lifting and lowering systems 91 and 263. These electrical hydraulic driven lifting and lowering systems 91 and 263 are responsible for lifting and lowering structural steel sections 272, 273 and 41*a* for proper roof positioning. Partial power from the cantilever solar panel 187 and direct current, battery charging system 187 may be used to activate hydraulic systems to maneuver sections 41*a*, 272 and 273. The desired height of the cantilever arm 41*a* is accomplished by Operator I relaying a coded signal 33*a* and 35 to the roof-mount cantilever receptor 34. These signals 33*a* and 35 activates the cantilever electric hydraulic systems 33*c*, 42*a*, 102 and 12, which operate hydraulic cylinders 74 and 240, that are supplied hydraulic fluid from hydraulic fluid tank 36, that is attached to the bottom frame of the cantilever housing 41*a*. Each cantilever housing section 272 and 273 blend with the motif of the high-rise building and are protected from the elements using enclosures 33*b* and 33*d*. As an option, the building's roof electrical receptacle 34*c* may be used for electrical current for operating the electric hydraulic systems 272 and 273. Major structural components which support the cantilever housing 41*a* are the cantilever pressure arm 37, cantilever pressure arm pivot pin 38, cantilever front support 39, diagonal strut, and weight distribution rail 42*b* and open race 55. The sectional cantilever housing 41*a* accommodates different height building parapets 271 and exterior wall thicknesses of a particular high-rise building. High-rise buildings with abnormal parapet heights and exterior wall thicknesses necessitate different configuration of roof-mount systems that are capable of being raised or lifted to different heights, and be adjustable, in order to accommodate emergency rooftop access or evacuation of a high-rise building. Reed's High-Rise Emergency Rescue Egress System, roof-mount 41*a*, is deigned to operate as a single unit or made a part of selected or custom designed structural lifting units. FIG. 11—Roof-mount system 41*a* is equipped with four retractable, swivel casters 197, left rear, 197*a*, left front, 197*b*, right rear and 197*c*, right front, for moving from one location to another on the roof of a high-rise building. Roof-mount 41*a* is a single stage lift system and is not raised or lifted from the roof's floor of a high-rise building. Roof-mount system 41*a*, cantilever 46 height is greater than, or equal to, the height of gondola 19 and block 15 when in the raised position at the top of a high-rise building. Roof-mount 41*a* allows occupants to mount or dismount from the gondola 19 on to, or from, the roof of a high-rise building. Roof-mount 41*a*, manufactured using structural lifting unit 272, is a one stage lift system. The roof-mount 41*a*, cantilever arm 46 using lifting unit 272, heights are greater than, or equal to, the height of gondola 19 and block 15 when in the raised position placing the bottom of the gondola 19 level with the top of the high rise building parapet or exterior top wall. The roof-mount 41*a*, to obtain maximum height, is raised from the roof's floor position of lifting unit 272 to the highest level of lifting unit 272, which positions the roof-mount 41*a*, cantilever arm 46 greater than, or equal to, the height of gondola 19 and block 15 when in the raised position at the top of a high-rise building. Roof-mount 41*a*, lifted via lifting unit 272 to this level allow occupants of gondola 19 to mount or dismount to or from the roof of the high-rise building roof.

Figure 12:
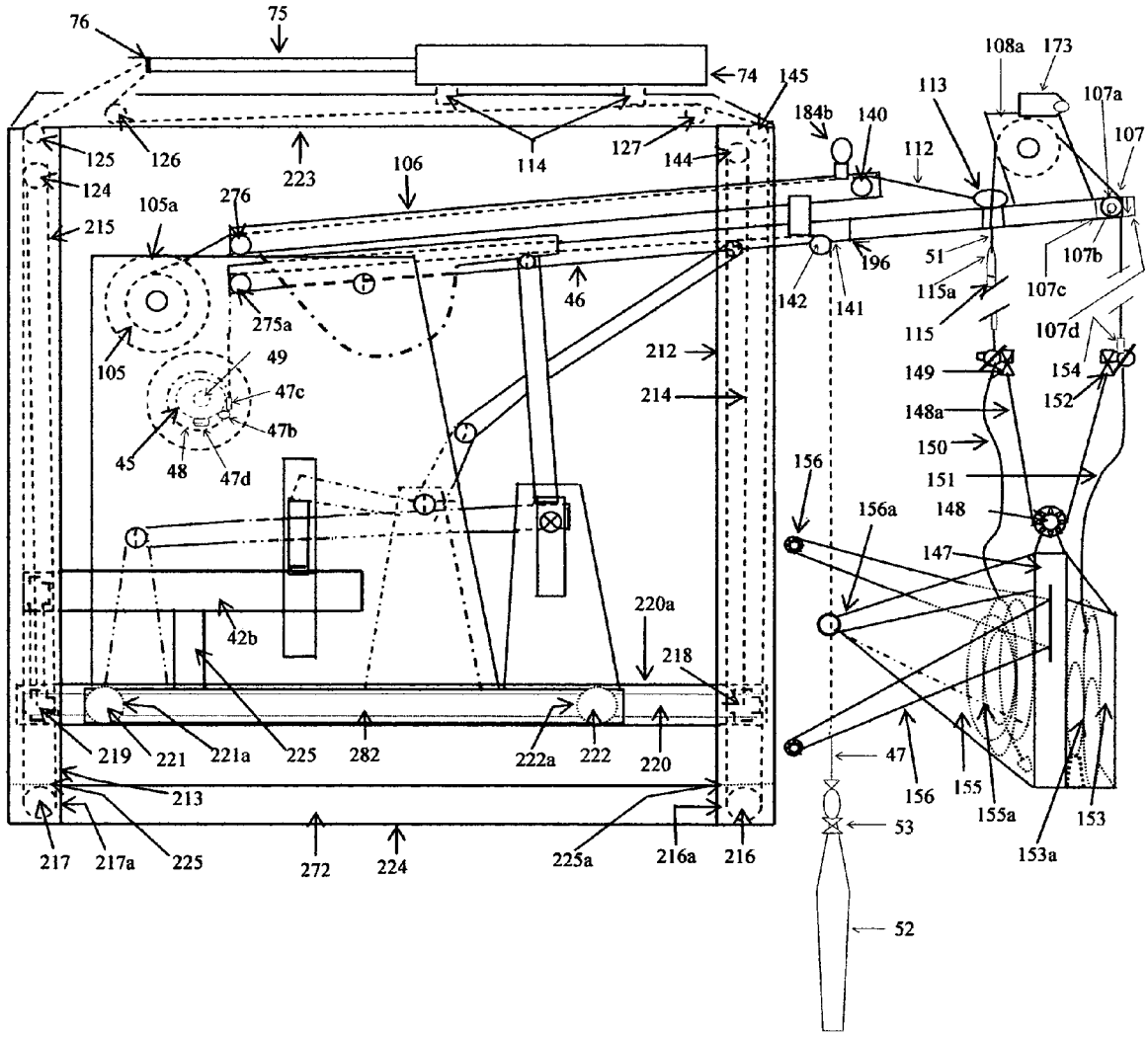
FIG. 12 is a drawing of a one stage lift system.
Figure 13:
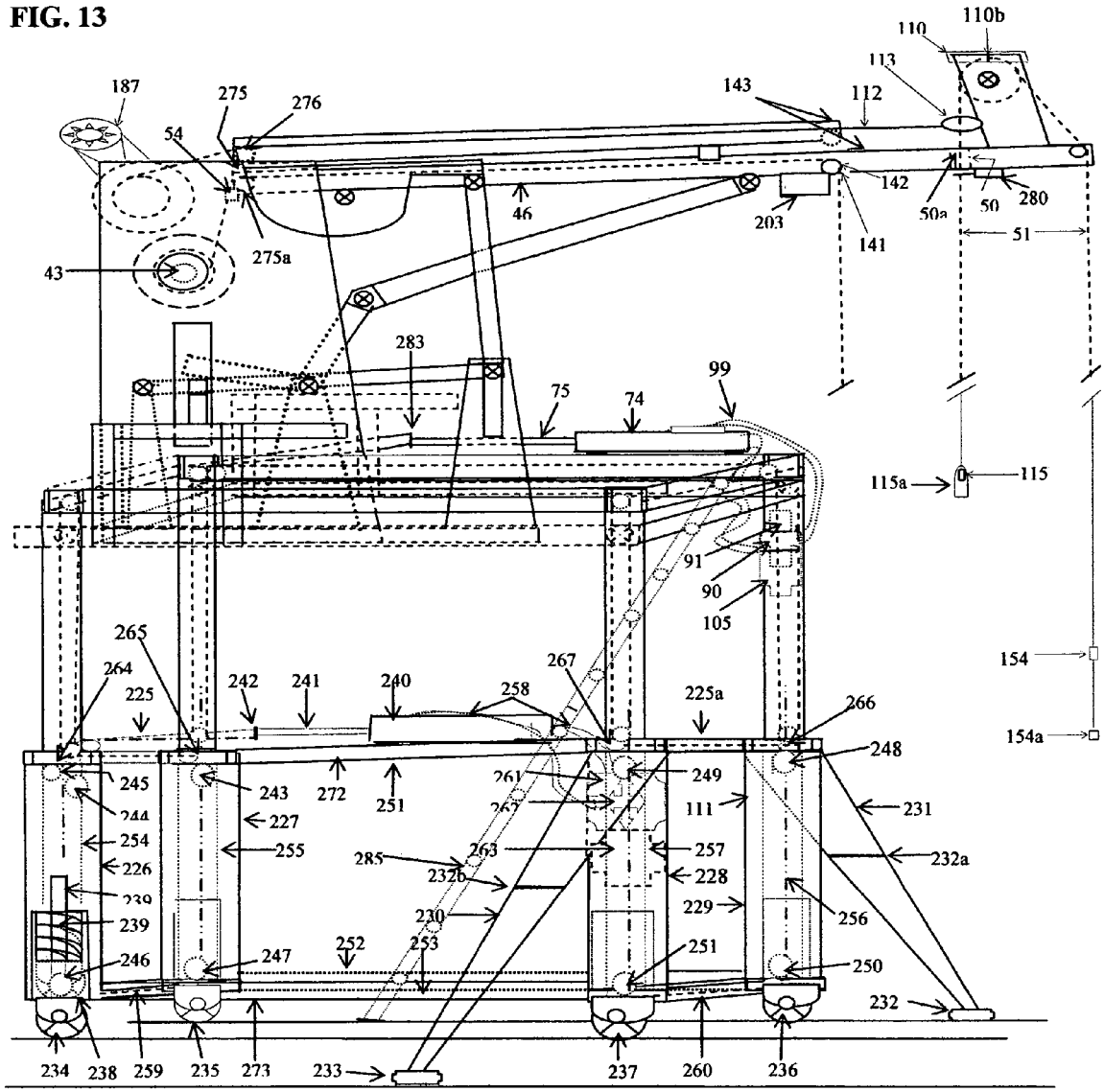
FIG. 13 is a drawing of a two stage lift system and is the same as FIG. 12, above, with exception to an additional frame system.
Figure 14:
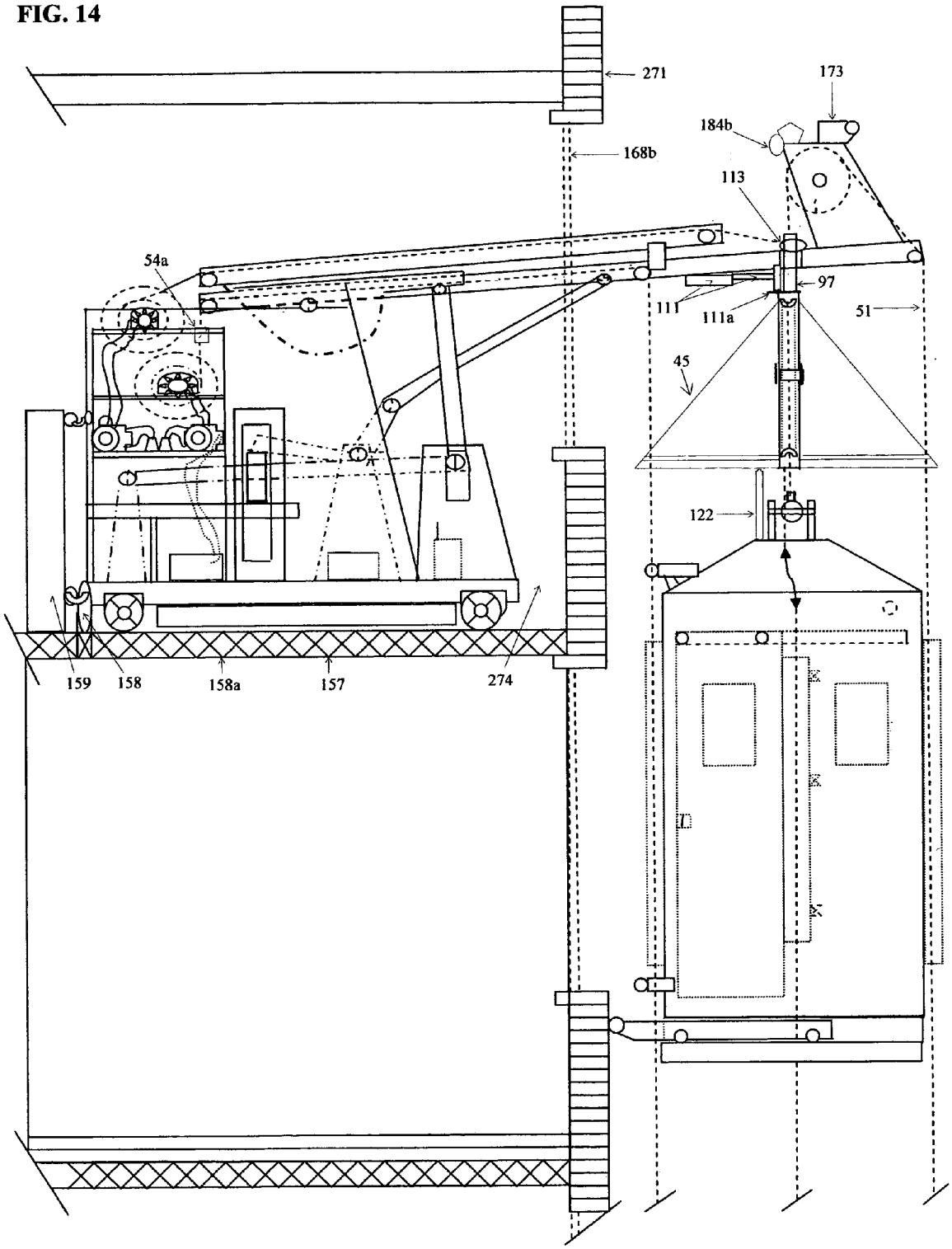
FIG. 14 displays a single stage, room-mount cantilever system with extended cantilever arm projected outside the window of a building. Attached to the cantilever arm is the block which is locked into position with the gondola in a maximum lifted height for occupants to dismount on the lower floor.

A two stage roof-mount lifting unit is obtained by fixing roof-mount 41*a* to the interior structure of structural lifting unit 272 and fastening roof-mount unit 41*a* and lift unit 272 to the interior frames of lift unit 273. Lifting units 41*a* and 272 are manufactured and mounted on the interior structural frames of lifting unit 273. The roof-mount system 272, in the lowered position of structural lifting unit 273, is equal to the height of 273, or greater than, or equal to, the height of 41*a* as a single unit. With structural lifting units 272, 273 and roof-mount 41*a* in their maximum raised position their height is more than, or equal to, the parapet or exterior wall of the high-rise building. For roof-mounts 41*a* to obtain its maximum height on a two stage lift system it is raised from the bottom stored position, mounted to structural lifting unit 272, to the highest lifting level of lifting unit 272. Then, structural lift unit 273 hoists roof-mount 41*a* and structural lift unit 272 to the maximum lifting height of 273. When structural lift units 272, 273 and roof-mount system 41*a* are raised or extended to their maximum heights, it allows roof-mount 41*a*, cantilever arm 46, to be positioned at a height greater than, or equal to, the height of gondola 19 and block 15, when in the raised position, attached to the top cantilever arm 47 at the top of a high-rise building. The bottom, open door entry, or floor, of gondola 19 is positioned opposite, and level with the top of the high-rise building parapet 271 or outer wall of the high-rise building which allow occupants to mount or dismount from gondola 19, on to, or from the building's roof. A ladder 285, dismount means, is assembled to the interior, front, of the structural lifting unit 272 that extends, at an angle, downward to the base of structural lifting unit 273. The framework of structural lifting unit 272 is constructed using fiberglass, metals, and other structurally solid selected materials. There are four vertical channel columns of different lengths and widths that have a variety of sheaves and cables modified and designed to form a lift unit to hoist and lower platform 272, in turn raises and lowers roof-mount system 41*a*. The vertical standards can be better understood by viewing FIG. 12 and FIG. 13. The structural lifting unit 272 has four vertical standards constructed of channel materials. Vertical standard 212, right front, vertical standard 212*a*, left front and vertical standard 213 left rear and 213*a* right rear. Each of the four vertical columns has sheaves mounted at critical hoisting locations. Top sheave 144, left front, sheave 144*a*, right front, sheave 145, left front, 145*a*, right front, sheave 217, and bottom sheaves 217, left rear and sheave 217*a*, right rear. Other vertical sheaves may be examined at FIG. 12. These sheaves are top sheaves 124, left rear, 124*a*, right rear, front sheaves 125 left front, 125*a*, right front, sheave 126, left rear, 126*a*, right rear, sheave 127 front left and sheave 127*a*, right front. The bottom sheaves are sheave 216, left front, 216*a*, right front, 217, left rear and 217*a*, right rear. Lifting unit 272 has four lifting cables mounted over and around the sheaves listed above, located inside the channel of the four vertical columns. These lifting cables are 214, left front and 214*a* right front and 215, left rear and 215*a*, right rear. The four cables are wound around the lifting sheaves and connected to the four ends of horizontal platform 282 that is fitted on its four corners with platform connector 219, left rear, platform connector 219*a*, right rear, platform connector 218, left front and platform connector 218*a*, right front. The opposite ends of cables 214, 214*a*, 215 and 215*a* are attached to cable hydraulic piston connector 283 attached to hydraulic piston 75 which, when activated, moves in and out from hydraulic cylinder 74 that hoists or lowers horizontal platform 282 and 41*a*. The horizontal platform 282 is equipped with two horizontal channel guide rails 220, left and 220*a*, right. This one stage roof-mount system 41*a* has four mounted wheels 221, left rear, 221*a*, right rear, 222, left front and 222*a*, right front. These four wheels are mounted two on each side near each outside corner. Roof-mount system 41*a*, moving on wheels 221, 221*a*, 222 and 222*a*, is positioned to the rear, open frame of 272 and wheels 221, 221*a*, 222 and 222*a* are inserted into the rear channel guide rails 220, left and 220*a*, right, and rolls 41*a* on to the platform 282 and locked. The roof-mount system 41*a*, in this location, mounted on platform 282, is stationed two-thirds the length of cantilever platform 282 of cantilever lifting system 272. The roof-mount 41*a*, cantilever platform 282 and lifting system 272 are supported by top horizontal support rails 223, left, top horizontal support rail 223*a*, right, bottom horizontal support rail 224, left, bottom horizontal support rail 224*a*, right, vertical brace 225, left, and vertical brace 225*a*, right. The structural lifting unit 273 has four vertical standards constructed of channel materials. Vertical standard 228, bottom right front, vertical standard 229, bottom left front, vertical standard 227, bottom right rear, and 226, bottom left rear. Each of the four vertical columns has sheaves mounted at critical hoisting locations. Top sheave 243, bottom right standard, top sheave 244, idler sheave, bottom left standard 245, bottom left standard, bottom sheave 246 bottom left standard, bottom sheave 247, bottom right standard, top sheave, right front standard 248, top sheave, left front standard 249 and bottom sheave, right front standard 250. Other vertical sheaves may be viewed at FIG. 13. Lift unit 273 has four lifting cables mounted over and around the sheaves listed above, located inside the four listed vertical columns mentioned above. The four lifting cables 254, 255, 256 and 257 are wound around the lifting sheaves and connected to the four bottom corners of horizontal lifting system 283 are constructed with rigid channel materials. These four bottom corner locations are the corners to the bottom frame of lift system 282. These corners are corner 223, left, horizontally, corner 224, right, horizontally, corner 225, left rear, vertical channel and corner 225*a*, right front, vertical channel. The lifting cables 254, 255, 256 and 257 are attached to corners 223, 224, 225 and 225*a* by cable connector 264, back left, cable connector 265, back right, cable connector 266, right front and cable connector 267, left front. The opposite ends of cables 254, 255, 256 and 257 are attached to cable hydraulic piston connector 242, which is attached to hydraulic piston 241, which is a part of hydraulic cylinder 240, hydraulic hoses 258, hydraulic pump 261, electric/hydraulic motor 262 and hydraulic fluid reservoir 263. When hydraulic cylinder 240 is activated it moves hydraulic piston 241, in and out that moves the lifting cables 254, 255, 256 and 257 up and down, therefore, moves lifting system 282 and 41*a* up and down to a desired location or position for receiving block 15 and gondola 19. The horizontal platform 283 is equipped with two horizontal charnel support rails 252 bottom, right, and 253 bottom, left. The channel support rail 252 connects with vertical guide standard 227, right rear, and vertical guide standard 228, right front. The channel support rail 253 connects with vertical guide standard 226, left rear and vertical guide standard 229, left front. This roof-mount system 41*a*, platform 282 is equipped with four wheels. Theses four wheels 221, left rear, 221*a*, right rear, 222, left front and 222*a*, right front, are mounted two on each side of platform 282 near each corner. Roof-mount system 41*a*, moving on wheels 221, 221*a*, 222 and 222*a*, is inserted into the rear channel guide rails 220, left and 220*a*, right, and rolls 41*a* on to the platform 282 and locked. The roof-mount system 41*a*, in this location, is stationed two-thirds the length of cantilever platform 282 of cantilever lifting system 272. The roof-mount 41*a*, cantilever platform 282 and lifting system 272 are supported by top horizontal support rails 223, left, top horizontal support rail 223*a*, right, bottom horizontal support rail 224, left, bottom horizontal support rail 224*a*, right, vertical brace 259, left, and vertical brace 260, right. FIG. 13—The lifting unit 273 is equipped with two outriggers mounted near the top outside front of vertical channels 228, left and 229, right, and extending, in a slanted position, to the floor or deck of a high-rise building. These outriggers are equipped with two roof grasping pod 233, left and roof grasping pod 232, right, that prevents lifting units 41*a*, 272 and 273 from swaying, tilting or overturning during operation. The outriggers 233, left and 232, right are adjustable for positioning at different lengths and angles for stability of lifting units 41*a*, 272 and 273. The cantilever lifting unit 273 is equipped with four casters or wheel units that can be rotated and are retractable. The retractable casters are caster 234, bottom left rear, caster 235, bottom right rear, caster 236, bottom right front and caster 237, bottom left front. Each caster, 234, 235, 236 and 237 are manufactured with swivel, bearing, axles or shafts that are mounted in wheel-well 238 bottom left rear, wheel-well 238*a*, bottom right rear, wheel-well 239, bottom front left and 239*a*, bottom right front. These wheel-well compartments are large enough to store each caster, shank and spring and are constructed to the outside, bottom or end of vertical channels 228, 229, 227 and 226. Equal weight is assigned to each caster 234, 235, 236 and 237. The wheel-well compartments are constructed to the outside, bottom, or end, of vertical channel 228, back, right, front, vertical channel 229 back, left, front, vertical channel 227, back, right, rear, bottom and vertical channel 226, back, left, rear. Equal weight is assigned to each caster 234, 235, 236 and 237. FIG. 13—Each caster section is equipped with a weight adjustment control lever 237*a*, left, rear, 237*b*, right, rear, 237*c*, right front and 237*d*, left, front and are adjusted according to the allowable, intended weights, cantilever lifting units 41*a*, 272 and 273 may hold. When weight is applied to cantilever arm 46 the weight is transferred to pressure arm 135 that transfers the weight to 136*a*, and using pivot 137 transfers the weight to 136, in turn, applies pressure or weight to cross member 40 that transfers the weight to the cantilever frame pressure arm that distributes the weight to the four casters or wheels. Once the applied weight to the cantilever arm 46 reaches the caster wheels tension is applied to the wheel-well springs, which retracts up, and into the wheel-well and allows the frame of roof-mount 41*a* or cantilever lifting unit 273 to move down and make contact with the roof of a high-rise building. This transferred weight is distributed equally to the circumference of the bottom frames of roof-mount 41*a* and cantilever lifting unit 273. Further, when weight is applied to cantilever arm 46 the weight is transferred from holding pivot pin 133, attached to structural mounting plate 134, right side, and 134*a*, left side, which carries the weight through the rocker arm 133*a*, arm, and applies that weight to rocker arm pressure beam 138, with sliding end in race 139, held by front brace 39, to cantilever pressure arm 38*a*, left and 38*b*, right held by pivot pin 38. The weight is distributed from cantilever pressure arms 38*a* and 38*b* to cross member 40 that transfers the weight to the cantilever frame pressure arm 27 that distributes the weight to the four casters or wheels. Once weight is applied to the cantilever arm 46 it is transferred to each caster or wheel 234, 235, 236 and 237, tension is applied to the wheel-well springs 284, 284*a*, 284*b* and 284*c*, which retract into the wheel-well 228, 229, 227 and 226 and allow the bottom frame of roof-mount 41*a* or cantilever lifting unit 273 to move down and make contact with the roof of a high-rise building.

When the cantilever roof-mount system is used for retrieving the block 15 from the top of gondola 19, for docking and locking to cantilever arm 46, there are three methods. One method is to permanently mount the cantilever housing 41*a* using roof connector 157 to the high-rise building roof deck connector 158, building joist 158*a*, and from vehicle 1, electronically signal receptor 34 to activate the block lift drum 105 to release the block lift cable 51 as a single cable to retrieve, dock and lock block 15 to the cantilever arm 46. Another option for the emergency responders is to use a special designed, permanent or temporary, cantilever system 41*a*, block lift drum 105, which is helicopter lifted to the top of a high-rise building and cranked up and down manually to retrieve block 15, dock and lock to the cantilever arm 46, for operation. The roof connector 157, connected to the high-rise building roof deck connector 158 that is fastened to a movable counterweight 159 is used rather than fastening the high-rise building roof deck connector 158 to the building roof joist 158*a*. The counter-weight 159, separate from the regular roof-mount system 41*a*, may be used and stored on top of a high-rise building or in a high-rise room. The room system FIG. 14 would be an alternative from the building's roof system 41*a*, FIG. 11. The roof-mount 41*a* counter weight 159 could weigh five hundred pounds, or more, depending on the integrity of the high-rise building's roof membrane structure. The roof-mount 41*a* counter weight 159 is equipped with four pivotal wheels. The most used cantilever system 41*a* for positioning, docking and locking block 15 to the cantilever arm 46 is the block lift drum 26, located in the draw-works section 6*a*, of body 163*a*, vehicle 1. The cantilever arm 46 may be designed in different configurations and manufactured to a building's particular roof dimensions. Due to wall thicknesses of some high-rise buildings a telescopic 196 cantilever arm 46 is used. Some high-rise buildings may require one of several cantilever roof-mount systems. Depending on the high-rise building's roof requirements, a cantilever roof-mount system 41*a*, 129 may be set in place by two man helicopter crew and manually operated. The helicopter cantilever roof-mount 41*a*, 129 and the manually operated roof-mount systems 41*a* would be considered temporary cantilever roof-mounts. The high-rise building owners may elect to use the permanently installed cantilever roof-mount 41*a* or cantilever room-mount systems 274. The cantilever 41*a* is temporarily roof-mounted using roof connector 146 connected to connector 158 or helicopter lifted using chain ring 129 and temporarily mounted to the top of a high-rise building using roof connector 146 connected to connector 158.

The stabilizer cable drum 45 is spooled with enough conductor stabilizer cable 47, sufficient in length, to be attached to the ground units, vehicle 1 and gondola 19. The major mechanical operating components of the stabilizer cable drum are shafts 43 and 49, chain 44, chain sprocket 44*a* and stabilizer cable 47. The stabilizer cable 47 is routed from stabilizer drum 45 over the protective roller 275*a*, through the hollow tube 275, of the bottom beam 46, and over a protective roller 142 and down through opening 141, located on the cantilever arm 46. In this stored position a modified lowering weight 53, with connector end 54, is connected to stabilizer cable 47 by connector end 51. To lower and attach the stabilizer cable 47 from the cantilever 41*a* to vehicle 1 located on the ground a signal is sent from vehicle 1, operator's room 3*c* and transmitter 33*a* by Operator I to the signal receiver 34, mounted in front of the roof-mount cantilever housing 41*a*, to lower the stabilizer cable 47 to vehicle 1. Once the stabilizer cable 47 arrives at vehicle 1, Operator I uses signal 33 in the vehicle's operator's room 3, to the roof-mount signal receiver 35, to stop the stabilizer cable 47. The micro-switch 54*a*, located at the roof-mount cantilever stabilizer drum 105, may also be used to stop the stabilizer cable 47 at the top of gondola 19. Operator II is responsible for initiating the initial connections for the stabilizer cable 47. Operator II, posted on the top side of block 15, which is lying horizontally, top of gondola 19, and reaches and grasps the stabilizer weight 53 and disconnects connector 52 from the stabilizer weight 53 and hands the stabilizer weight 53 to Operator III, positioned inside the gondola 19, with the front door 68 open, and Operator III discards the stabilizer weight 53. Operator II then hands Operator III the stabilizer cable 47. Operator III reaches out, and up, and grasps the stabilizer cable 47 then unlatches locking brackets 56*a*, 56*b* and 56*c*, on the hinged cable guide 27, and places the stabilizer cable 47 inside the hinged cable guide 27, and closes and locks the hinged cable guide 27, which is mounted on the front center of the gondola 19. Operator III kneels down and places the stabilizer cable 47, end 47*a*, in to the stabilizer cable tube guide 57, piped entry 57*a*, which is positioned under the hinged cable guide 27. Operator III then maneuvers the stabilizer cable through the stabilizer cable guide tube 57 until the stabilizer cable 47 and end 47*a*, exits the stabilizer cable guide tube 57, exit 47*a*, located on the back side of gondola 19, draw-works section 6*a*, sheave 27*b*. Operator II dismounts his post atop the gondola 19 and positions himself inside the draw-works section 6*a*. Operator II grasps, and pulls the exposed stabilizer cable 47, end 47*a* and connects the conductor line cable fitting 47*a* to the conductor line cable fitting 59*a*. There is an electrical receptacle 59 built in to the stabilizer drum 58, flange receptacle 26. The stabilizer cable vehicle drum 58 is mounted on a square steel frame 58*a* that is mounted with steel bolts to frame 163 of vehicle 1. Mounted on the side of stabilizer drum 58 is an electrical slip ring 48 that is connected to the vehicle 1, electric generator 29. The generator 29 supplies alternating and direct electrical current to the stabilizer cable slip ring 48, in turn, the stabilizer cable slip ring 48 supplies the current through the stabilizer conductor line cable 47, to the cantilever roof-mount system 41*a*. This electrical current is directed to the cantilever arm 46, cantilever arm 106, electric motors, micro switches, and other electrical components built in to the cantilever roof-mount system 41*a*. Once the stabilizer cable 47 is connected to the vehicle 1, electrical generator 29, Operator I reverses the stabilizer drum 58 and slowly tightens the stabilizer cable 47. Operator I tighten the stabilizer cable 47 enough to allow gondola 19, to be stabilized when being raised and lowered. The exact amount of pound pressure applied to the stabilizer cable 47 is controlled and monitored 3*a* in the control rooms 3*c* and 3*d*. Also, this maneuver stabilizes and acts to vertically position block 15 and the stinger coupling 97 to enter the bottom 50 of cantilever arm 46 for docking and locking.

The cantilever roof-mount system 41*a* is positioned on top of the high-rise building. The cantilever housing 41*a* has a horizontal supporting frame 101 where the block lift drum 105 is mounted. A single control cable 112 is attached to the block lift drums 105 flange 105*a* and the opposite end, with an attached bronze bull nose ring 113, has the block lift cable 51 threaded through its center. With the single control cable extended and the block lift cable 51 threaded, one end of cable 51 is placed over the large sheave 109, down and through the end of beam 46 and over 107*a* and through 107 and to the ground. The other end of block lift cable 51 is threaded through beam 46, opening 50 and to the ground. This allows the block lift cable 51, with its two ends on the ground, to use sheave 109 as a pulley system for retrieving block 15 from the top of gondola 19 docks and locks the block 15 to the cantilever arm 46, which is positioned on the top of a high-rise building. The block lift cable 51, while in the hoisted and stored position, under beam 46, has a controlled weight 147 attached to the double cable ends 115 and 154 of the block lift cable 51. The controlled block weight 147 may be modified to different configurations to satisfy a high-rise buildings cantilever connection requirements. FIG. 12 provides a more detailed view of how the controlled block weight 147 affords stability during ascent and descent of the block 15, lift cable 51. The parts utilized to manufacture the control block weight 147 are the block cable length adjustment sheave 148, length adjustment cable 148*a*, length adjustment cable connector, inner 149, block lift cable disconnect end 150, block lift cable, unattached, block lift drum end 151, length adjustment cable connector, outer 152, block cable, unattached, storage compartment, block drum connector end 153, excess block lift cable 51, back side, 153*a*, pressed lug affixed to cable end that attaches to 26 block lift drum 154, electric attachment 154*a*, block cable, unattached, storage compartment, block connection end 155, excess block lift cable 51, front side 155*a*, weight guide, right, 156, weight guide, stabilizer cable, center, 156*a* and weight guide, left, 156*b*. A controlled weight 147 is designed with a length adjustment cable 148*a* for connecting to cables ends 51. The engineered weight 147 is used to maintain calculated pressure on the block lift cable as it is raised and lowered up and down the side of a high-rise building. The controlled weight 147 is equipped with an extended guide 156*a* which encircles the stabilizer cable 47 allowing the stabilizer cable to be used as a taut guide as the weight is lowered or raised. The engineered weight 147 has two extended arms 156, right and 156*b*, left, that expand outward at an angle and acts as rudder guides. These guides prohibit the block lift cable 51 from twisting or turning during ascent or descent of the high-rise building. One guide, or the other, will touch the outside wall of the high-rise building before a twist can be made in the block lift cable 51. The controlled weight 147 provides for necessary excess block lift cable 51 storage in two designated storage compartments. These two compartments are fastened to the front 153, and the back side 155, of the controlled weight. The controlled weight 147 is equipped with a small top mounted sheave 148 that is strung with a two ended length adjustment cable 148*a*. The length adjustment cable 148*a* is equipped with two connectors, ends 149 front and 152 back. The front adjustment cable connector 149 connects to front connector 115 that is attached to an upper, front portion, of the block lift cable 51. The back adjustment cable connector 152 is connected to the back connector 154 that is attached to a back, upper portion, of the block lift cable 51. To lower and connect the block lift cable 51 from the cantilever block cable drum 105, an electronic signal is sent from vehicle 1, control room 3*c*, to transmitter 33, signal receiver 35, which activates the electric hydraulic system 102 to turn the block lift cable drum 105 forward which drops the double ends of the block lift cable 51, that is attached to controlled weight 147, to the vehicle 1 located on the ground below. With the controlled weight 147 lowered and positioned above block 15 and gondola 19, Operator II, stationed atop gondola 19, safety platform 268, removes the excess cable 155*a* from compartment 155 and connects the block lift connector 115*a* onto the block stinger coupling connector 97, that is used to lift the block 15. Once this connection is made Operator II then disconnects connector 152 from 154 and hands the cable 151 to Operator III, positioned in the draw-works section 6*a*, behind the gondola 19, who then takes out excess cable slack. Operator II then disconnects connector 149 from connector 115 and holds cable 150 while Operator II removes the remaining cable slack. Operator III then hands Operator II cable end 115 and he places cable end 115 down and through block guide 100*c* to Operator III who receives the block cable end 115 and places it through the back cable guide 27 and affixed to the back of gondola 19. During this procedure Operator II takes the position of Operator III to hold the slack cable. Operator III further places the block lift cable 51, end 115 through the floor mounted sheave 160 and 27*b*, FIG. 8, behind the gondola 19 and through the fleet angle compensator 26*a* and connect the block cable end 115 to the vehicle 1, block lift drum 26. While Operator II holds slack, a signal is given by Operator III to Operator I, located in control room 3*c*, to activate and rotate the vehicle's block lift drum 26 forward. Operator I apply monitored tension to manual brakes 9, main lift drums 8 and 8*a* and main lift cables 11, left and 11*a*, right. Operator I rotate the block lift drum 26 forward which removes the cable slack held by Operator II. Operator II places the controlled weight 147 on to the controlled weight hanger 255 located in the draw-works section 6*a*. Operator II and Operator III exit the draw-works section and the block 15 is now ready to be lifted and attached to the cantilever arm 46. Once the block lift drum 26 is placed in the lift mode block 15 begins to ascend the high-rise building outside wall and retrieves cables 16, left and 16*a*, right from the main lift drums 8, left and 8*a*, right. The main lifting cables 16, left and 16*a*, right, outer ends, which are attached to the single tree connections 16*b* and 16*d*, atop the gondola 19, remain stationary thus allowing cables 16, left and 16*a*, right to be unwound from the main lift drums 8, left and 8*a*, right, and the block 15 to be lifted to the block locking position 50*a* on the roof-mount cantilever arm 46. The block's 15 position is monitored by Operator I, operator room 3*c*, controls 3*g*, monitor 119 as it is lifted and approaches the locking and docking position 50*a* to the cantilever arm. Operator I releases brake control lever 63*c* to the block lift drum 26 forward, while maintaining some cable tension, and moves block control lever 3 and 3*c* forward, turning the block lift drum 26 and begins retrieving cable 51, which is positioned around 109 and back down and attached to the block 15, block lift stinger coupling 97. As the block lift cable 51 is being wound around the block lift drum 26, the block 15 is lifted and moves upward. During this maneuver the height indicator 119 maintains a height count, in feet. As the block 15 approaches the cantilever arm 46 the height monitor 119 signals the block lift drum 26 to slow its approach of block 15 as the block stinger coupling 97 enters stinger hole 111, in the cantilever arm 46, for docking and locking. Micro-switch 46*a*, located on the underneath side of the cantilever arm 46, is activated during the docking and locking procedure and signals the control room 3*c*, panel 3*d*, Operator I that block 15 is docked and locked to the cantilever arm 46 and is ready for gondola 19 to be released from the hold down brackets 118 and 118*a* and lifted to various positions on the outside wall 271 of the high-rise building or to the roof. Once block 15 locking jaws 98 and 98*a* make contact with cantilever arm 46, outward pressure is applied to the block lift jaws 98 and 98*a* by the square configuration of the cantilever arm 46, that causes the block locking jaws 98 and 98*a* to spread and close by tension springs 100*d* and 100*e*, and lock to the top side 50*a* of the cantilever arm 46. On the underside of the cantilever arm 46 and slightly back from opening 50, is mounted an electric solenoid 111 positioned to stop block 15 from going higher than the locked position that would unlocking block 15 from the cantilever arm 46. The electric solenoid is designed with a lengthy cylinder and a measured block 111*a* attached to the end of its cylinder. The measured block 111*a* is placed in the space between the bottom of the cantilever arm 46 and the top frame 94 and 94*a* of block 15, which prevents the block from being raised too high and unlock the block 15 until the electric solenoid 111 is activated and relocates 111*a* back for unlocking block 15. To reposition or store the block lift cable 51 back on to the block cable drum 105 an electronic signal is sent from vehicle 1, control room 3*c*, to transmitter 33, signal receiver 35, which activates the electric hydraulic system 102 to turn, in reverse, and retrieve the single cable 112 with the attached bull ring 113, that in turn retrieves the block lift cable, that is now in the lowered position, doubled, and weaves it on to the block cable drum 105. Micro-switch 280 discontinues movement of the block lift cable 51 when the correct amount of the block lift cable 51 is returned and wound back on to block cable drum 105. An alternating or direct current lighting system 184, mounted on top of cantilever beam 106, end nearest 109, supplies illuminating lights 184*b* for monitoring roof top operations.

Communication Summary—with a Remote Command and Control Center:

A mobile emergency rescue vehicle is used in conjunction with fixed high-rise lifting equipment.

The emergency rescue vehicle carries the gondola and houses all of the command and control instrumentation to operate the gondola.

The operator is capable of communicating with the rescue personnel in the gondola at all times. The operator is able see and responds to situations in the gondola, the building, and the building top. This is accomplished through a system of highly sophisticated remote cameras and monitoring systems.

The operation requires that the emergency rescue vehicle be located directly under the lift site besides the high-rise building. Due to the possibilities of falling debris and other unknown hazards a Remote Command Center (RCC) vehicle is needed and has been included in the design of the total high-rise emergency rescue system package.

The Remote Command Center has the operational capabilities as the high-rise emergency rescue egress system itself The Remote Command Center is used exclusively, after deployment, or in conjunction by the on the scene fire commander or responder for monitoring the rescue operation progress. At the scene of the high-rise emergency the situation became too dangerous for personnel on the ground, the Remote Command Center vehicle is used for monitoring, communication, command and control.

High-Rise Emergency Rescue Egress System Building Top Control System—Remote Terminal Unit (RTU):

The component used for the actual control interface to the lift equipment is the Motorola MOSCAD RTU (Motorola Supervisory Control and Data Acquisition Remote Terminal Unit). This is a very versatile and reliable control system that collects data through discrete analog I/O connections and provides control with digital outputs. It functions very much like a Programmable Logic controller. It is a smart device that can be configured utilizing Ladder Logic to accommodate any type of devices and a wide range of process operations.

Control Communications:

The communications link to the Remote Terminal Unit (RTU) is via Wireless Broadband and Analog two-way radio. This way there is a redundant link to the device. The two-way link is established while en route to the site for initial operations or a remote fixed site may house backup systems to initialize the lowering of the stabilizer and block lift cables through the two-way link.

The technology used for the control communications link is in the Wireless Broadband 802.1x technology and has the necessary bandwidth to accommodate all video and control signaling. An Access Point Cluster is fixed to the cantilever lift arm for establishing communications link with the ground vehicle and gondola equipment.

Reed's High-Rise Emergency Rescue Egress System has remote monitoring and testing of all functionality built into the communication systems. Therefore, remote testing is performed on a daily basis. The emergency responders will not have to wait until a training exercise or an actual deployment to discover if all systems are functioning properly.

Voice Communication:

An Onsite Repeater is housed on the rooftop for communications with the ground operators. The actual frequency for this voice system is coordinated with the responding emergency agencies ahead of time. This is necessary to extend coverage through the site and possible building penetration. It also has a range of operation that serves for voice operations for an entire cluster of buildings. Therefore reducing cost on successive deployments in the same area.

Camera System:

A high quality wireless camera is deployed onto the cantilever arm for pan, tilt and zoom operations and is operated from the emergency rescue vehicle, remote command vehicle or a remote monitoring station. This will interface to the Wireless Local Area Network (WLAN). This is used to monitor the roof-mount equipment on the buildings roof and the progress of operations from a top down view.

Gondola Camera System:

The cameras will be fixed at points outlined in FIG. 1, FIG. 2, FIG. 3, FIG. 4, FIG. 9, FIG. 10, and FIG. 11. There will be five cameras mounted in designated locations to monitor and view the building face, personnel inside the gondola, and a view from the building's roof top looking down and a view from the gondola looking up. These cameras are digital TCP/IP based cameras for connection to the Monitoring Control Point via the WLAN Connection.

Voice Radio:

A high quality Motorola two-way radio is installed for voice communications with all essential ground operations personnel. This is a multi-channel radio for redundancy back-up channel operations in case of a repeater failure. This is powered via an installed rechargeable battery pack.

Wireless Local Area Network (WLAN) Subscriber Module:

The wireless link for the video feeds is a Motorola Wireless Broadband device. This device is from the Motorola Canopy Group. Once powered up it establishes a link with the Building Top Access Point. All TCP/IP data is routed through this device.

Ethernet Switch Equipment:

All camera devices located in the gondola will establish their communications links through the Ethernet Switch. This device is located in a NEMA-4 Outdoor enclosure to protect it from the environment.

Rescue Operations Center—Equipment Control Center:

This is the hub of all systems and sub-systems. It consists of the control portion of the MOSCAD system. The interface is a GUI (Graphical User Interface) located on a standard PC. All deployment and lifting operations are controlled and monitored through this interface. For redundancy purposes the GUI will be on two separate PC's. The control system beneath the PC layer is a MOSSCAD IP Gateway. This is the actual interface to the rooftop RTY system via the MDLC (Motorola Data Link Communications) network.

WLAN System:

The primary purpose of the WLAN system is for the video camera systems. The rescue vehicle will be outfitted with several Canopy Subscriber Modules and Ethernet Switching gear. This is the hub for the self contained WLAN system.

Video Control Center:

At least two Video Monitors and Multiplexers are housed in the emergency rescue vehicle. This is where all control and monitoring of the cameras will be done. Overhead monitors will be fed the recovered digital signals from WLAN system.

Battery Backup System:

A backup battery charging system is mounted on the emergency rescue vehicle. This is used to maintain a spare battery pack charged at all times for the gondola. If the gondola battery system gets depleted this second battery pack would be deployed for extended operations. It is designed to be easily swapped into the gondola. The battery charging system is designed to keep both sets of batteries charged at all times when not deployed.

WLAN Subscriber:

The primary purpose of the WLAN system is to be connected to the network for remote operations. The command vehicle is outfitted with one Canopy Subscriber Module and Ethernet Switching gear. This allows an on the scene commander to monitor the rescue operation from a remote location.

Equipment Control Center:

A PC is installed in this Remote Command and Control vehicle with the same full capabilities as the Reed's High- Rise Emergency Rescue Egress System vehicle. However, it operates as an extension of the main operation center. The PC is connected to the MOSCAD IP Gateway located in the emergency rescue vehicle via the WLAN system.

Video Control Center:

This is a fully operational secondary monitoring and control system. It has the ability to monitor and control all cameras on the WLAN system.

What I claim as my invention is:

1. A high-rise rescue emergency rescue egress system that provides ground vehicle means of self leveling body and;

(a) a means to rotate vehicle's body certain degrees from body's straight line mount on said vehicle's permanent frame; means from vehicles control room to extend said body providing extension and withdrawal of said body allowing positioning of said gondola;

(b) means provided by units control systems to guide said gondola at certain degrees and angles with controls on the interior of gondola;

said means to disengage and exchange gondola's from said rescue carrier to construction and maintenance gondola carrier;

and to move vertically said gondola by means of body control systems providing positioning of said gondola for necessary mount and dismount;

said gondola single tree lifting device mechanism atop gondola providing alternate electric current or direct electric current via conductor line cable means to said gondola to operate gondola operational and camera systems;

said gondola single tree lifting device providing means for single cable lifting of said gondola when in fact one of two lifting cables are removed from single tree lifting device attached to top of gondola for lifting said gondola;

for guidance of gondola when moving up and down the side of high-rise building;

for stabilization means equipped gondola carrier provides gyroscope balancing of gondola while in use for purpose of wind control of gondola while traveling up and down the exterior wall of a high-rise building;

and means to dismount gondola by means of repelling from gondola by means of repelling equipment, from gondola to ground;

and gondola to have means provided for which water is disseminated by means of water distribution systems providing from water hose connections to gondola and controls of the water displacement equipment;

(c) and vehicle control provides braking means by manual and disc brake means to gondola via way of lifting cables, safely stopping gondola at will;

(d) and vehicle control unit allows for provisions of alternating electrical current and direct electrical current by means of an electrical generator from said vehicle to said stabilizer cable mounted on to truck body, to said gondola for operation of gondola equipment;

(e) and a cantilever block lifting device mounted atop of said building for the purpose of lifting block from gondola to lock and dock to said cantilever arm; and a temporary cantilever lifted, placed and mounted by helicopter to the top of a high-rise building;

and means by which manual lifting with handle mounted on block lift drum of block from gondola to temporary cantilever system, locked and docked;

(f) and means by which gondola is used for transporting, detecting chemical warfare (vapor) equipment, for purpose of detecting vapors from within the high-rise buildings that has been attacked by terrorist or other means;

(g) and means by which direct current batteries, located inside the cantilever housing, are electrically charged by means of a solar panel that provides electrical charging capabilities to cantilever housed direct current batteries.

(h) and means by which cantilever arm is electronically activated via a signal from the vehicles control room to raise and lower the cantilever arm which is attached to the cantilever frame;

(i) and means by which the gondola may be lifted and lowered by the use of one cable attached to the lifting attachment atop the gondola and extended up and through the block's sheave, down and attached to the gondola lift drum which has mechanical turning, lifting and lowering capabilities.

* * * * *